US008212462B2

(12) United States Patent
Kato

(10) Patent No.: US 8,212,462 B2
(45) Date of Patent: Jul. 3, 2012

(54) SPARK PLUG AND MANUFACTURING METHOD THEREFOR

(75) Inventor: Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/123,467

(22) PCT Filed: Oct. 9, 2009

(86) PCT No.: PCT/JP2009/067611

§ 371 (c)(1),
(2), (4) Date: Apr. 8, 2011

(87) PCT Pub. No.: WO2010/041733

PCT Pub. Date: Apr. 15, 2010

(65) Prior Publication Data

US 2011/0193471 A1 Aug. 11, 2011

(30) Foreign Application Priority Data

Oct. 10, 2008 (JP) ..... 2008-263597

(51) Int. Cl.
*H01T 13/20* (2006.01)

(52) U.S. Cl. ..... 313/141; 313/118; 313/142; 313/143; 445/7

(58) Field of Classification Search ..... 313/118, 313/141–145; 445/7
See application file for complete search history.

(56) References Cited

U.S. PATENT DOCUMENTS

| | | | | |
|---|---|---|---|---|
| 5,574,329 | A * | 11/1996 | Kagawa | 313/141 |
| 6,091,185 | A * | 7/2000 | Matsubara et al. | 313/138 |
| 6,215,235 | B1 | 4/2001 | Osamura | |
| 2002/0050775 | A1 | 5/2002 | Hori | |
| 2002/0158559 | A1 * | 10/2002 | Sugiyama et al. | 313/141 |
| 2005/0057135 | A1 * | 3/2005 | Yoshimoto et al. | 313/141 |
| 2008/0100193 | A1 * | 5/2008 | Takeuchi et al. | 313/141 |

FOREIGN PATENT DOCUMENTS

| | | | |
|---|---|---|---|
| JP | 11-233233 | A | 8/1999 |
| JP | 2002-033176 | A | 1/2002 |
| JP | 2003-017214 | A | 1/2003 |
| JP | 2007-234435 | A | 9/2007 |

* cited by examiner

*Primary Examiner* — Joseph L Williams
*Assistant Examiner* — Kevin Quarterman
(74) *Attorney, Agent, or Firm* — Sughrue Mion, PLLC

(57) ABSTRACT

A spark plug in which the center electrode is formed by laser welding along the circumference of a joint surface between a center electrode base metal and a noble metal tip in excess of full circumference. When G represents a spark gap and A represents a shortest gap between a laser weld bead and a line drawn parallel with axis X, A≦3G. Straight lines S1 and S2 which connect the center of the noble metal tip 1 and the circumferential center of a proximal end 52 of the ground electrode 51 and vertex 8 of a protrusion 7 formed at a final end portion 6*e* of a bead 6 formed by circumferential laser welding, respectively, form an angle θ of 45 degrees. Since the protrusion 7 of the bead is the angle θ away from the ground electrode 51, an abnormal discharge is unlikely to be generated.

15 Claims, 14 Drawing Sheets

SPARK PLUG AND MANUFACTURING METHOD THEREFOR

TECHNICAL FIELD

The present invention relates to a spark plug for use in an internal combustion engine and to a method for manufacturing the same.

BACKGROUND ART

There are proposed a large number of spark plugs used to provide ignition in an internal combustion engine, such as an automobile engine, and configured such that a noble metal tip which contains Pt, Ir, or the like as a main component is welded to an end of an electrode in order to enhance resistance to spark-induced erosion (refer to, for example, Patent Document 1). Particularly, use of the noble metal tip is very effective for a center electrode, since spark-induced erosion of the center electrode is large.

Meanwhile, laser welding is the favored method of welding such a noble metal tip to a center electrode base metal in forming the center electrode. The general practice of laser welding is as follows. A noble metal tip (circular columnar body) is positioned and disposed, via one end surface thereof, at the center of a front end surface of the center electrode base metal (Ni or Ni alloy). Then, the outer circumferential edges of joint surfaces (portions) of the two members are fused and joined together along the circumferential direction.

Meanwhile, recently, strong demand has arisen to reduce the diameter of a spark plug. In association with such demand to reduce the diameter of a spark plug, difficulty is encountered in securing a sufficiently large space (hereinafter, may be referred to as a lateral gap) between the circumferential surface of the noble metal tip of the center electrode and a portion of the ground electrode (outer electrode) located toward the proximal end of the ground electrode (a portion of the ground electrode located toward the front end of a metallic shell) as compared with a spark gap between the front end of the noble metal tip and the distal end of the ground electrode (hereinafter, may be referred to as the regular gap indicative of a regular spark gap (dimension) between the electrodes) G. Specifically, when G represents the spark gap (dimension) and A represents the shortest gap (dimension) between a laser weld bead and a line drawn in parallel with the axis of the metallic shell along the inner surface of a proximal end portion of the ground electrode which faces the center electrode, G and A may establish the relation $A \leqq 3G$ in the case of a spark plug having a certain diameter (mounting screw diameter). This may cause the generation of discharge across the lateral gap (referred to as an abnormal discharge) instead of the generation of discharge across the regular gap. Particularly, in the case where a spark plug is used in a direct-injection engine in which an atmosphere within a combustion chamber is nonuniform or in an engine which involves an intensive swirl (air-fuel mixture flow), if the proximal end (root) of the ground electrode of the spark plug is located downstream of the air-fuel mixture flow, the generation of abnormal discharge is highly likely. Such discharge or sparking across a gap other than the regular gap may fail to initiate regular ignition of fuel, with a resultant deterioration in combustion performance, and thus raises a problem of deterioration in ignition performance.

PRIOR ART DOCUMENT

Patent Document

Patent Document 1: Japanese Patent Application Laid-Open (kokai) No. H11-233233

SUMMARY OF THE INVENTION

Problems to be Solved by the Invention

In view that the above-mentioned abnormal discharge is generated relatively frequently in a spark plug having a center electrode formed such that a noble metal tip is welded to a center electrode base metal, the inventor of the present invention carried out studies and found the following: the abnormal discharge or lateral sparking is likely to be generated between a portion of the ground electrode located toward the proximal end of the ground electrode and a weld bead (a region where molten metal associated with welding is solidified) formed along the circumference (on the side surface) of the noble metal tip. In the case where the end surface of the noble metal tip is positioned and disposed on the end surface of the center electrode base metal and the outer circumferential edges of joint surfaces (portions) of the two members are to be laser-welded together along the circumferential direction, the outer circumferential edges of the two members between which the joint surfaces are sandwiched are melted, and the molten metal is solidified; thus, a bead formed of an alloy which contains the metal components of the two members remains in a continuous form in a region corresponding to the outer circumferential edges of the two members. Such a weld bead is very small in width and height. However, in microscopic view, the surface of the bead is irregular; thus, an electric field is apt to concentrate thereon. Additionally, the bead has a metal oxide film formed thereon; thus, electrons are easily emitted. Accordingly, a discharge is easily generated from the irregularities. The inventor of the present invention has conceived that this is a primary cause for induction of an abnormal discharge.

Under the above circumstances, the inventor of the present invention continued studies and tests and found a decisive cause for generation of abnormal discharge. It is the following phenomenon, whose detailed mechanism of generation will be described later: when the outer circumferential edges of the joint surfaces (portions) of the center electrode base metal and the noble metal tip are subjected to laser welding along the circumferential direction, a final end portion of a bead which is the terminal of welding locally rises in the radial direction of the center electrode (hereinafter, may be referred to merely as the radial direction) a very small amount of 0.03 mm to 0.2 mm higher than does the other bead portion, thereby forming a protrusion (projection or mound; hereinafter, may be referred to merely as a protrusion). The inventor of the present invention has conceived that, when the protrusion faces a side toward the proximal end of the ground electrode or is located very close to the facing position in the state of assembly as a spark, plug, the frequency of generation of abnormal discharge is high. On the basis of this inference, the inventor of the present invention et al. tested a large number of samples which differed in the position of the protrusion relative to the ground electrode; i.e., the position of the final end of a bead relative to the ground electrode. The test results conformed to the inference. The protrusion which causes the generation of abnormal discharge is formed by the following mechanism.

Conventionally, in welding the noble metal tip to the center electrode base metal, in order to ensure that a weld portion extends along the full circumference of the noble metal tip for enhancing welding strength, welding is performed along the circumference of the noble metal tip in excess of full circumference (full circumference+α). That is, circumferential welding which starts from a welding start point does not end at the welding start point, but ends at a position located an appropriate distance circumferentially beyond the welding start point. In such welding performed in excess of full circumference, a final end portion of a bead overlies a bead portion which is located at the welding start point and has been melted and solidified. Meanwhile, no new bead is formed on the final end portion of the bead. Therefore, the final end portion of the bead differs in surface form from the other bead portion. The final end portion of the bead assumes the form of an irregular projection or mound-like protrusion which is radially higher than the other bead portion.

The generation of such a protrusion is not limited to the case of continuous laser welding. Specifically, in circumferentially welding the outer circumferential edges of the joint surfaces of two members by a pulse (oscillation) laser, pulse laser irradiation is repeated sequentially a plurality of times along the circumferential direction at equal angular intervals in such a manner that beads partially overlap one another from a welding start point. At this time, no new bead is formed on the final end bead which is formed by the final (end point) laser irradiation of circumferential welding. Thus, even in the case of pulse laser welding, the protrusion is formed at the final end portion of a series of beads.

Meanwhile, a method of performing laser welding in the circumferential direction along the circumference of a joint surface between the center electrode base member and the noble metal tip in excess of full circumference is not limited to use of a single laser welding machine (laser welding shot from a single direction), but may use a plurality of laser welding machines. For example, in the case where laser welding is performed by use of two laser welding machines in such a manner that, as viewed in the axial direction from the front end of the noble metal tip, a laser is shot from two directions at two respective positions located diagonally from each other with the center of the tip therebetween (located 180 degrees apart from each other), laser welding can be performed circumferentially in excess of full circumference by means of turning the center electrode base metal one-half turn (the amount of turn depends on the size of a weld portion formed by one pulse shot, but in actuality, is less than one-half turn) about the axis. Thus, welding time is shortened, and the manufacturing efficiency is enhanced.

Meanwhile, in the case of such welding, since the welding machines form respective beads, the final end portion of a bead (hereinafter, may be referred to as the end portion or as the end) exists at two positions located diagonally from each other. Therefore, in this case, an irregular projection or mound-like protrusion which is relatively high in the radial direction exists at the ends of the beads; i.e., at two positions. Similarly, in the case where laser welding is performed by use of three laser welding machines in such a manner that, as viewed in the axial direction from the front end of the noble metal tip, a laser is shot from three directions at three respective positions located at 120-degree circumferential intervals so as to perform laser welding circumferentially in excess of full circumference about the axis of the center electrode base metal, the protrusion exists at the ends of three beads; i.e., at three positions.

Further, the inventor of the present invention carried out extensive studies and found that even a portion other than the end of a bead may assume the form of an irregular projection or mound-like protrusion which is radially higher than the other bead portion. This is for the following reason. In welding the noble metal tip to the front end of the center electrode base metal, the very small, circular columnar noble metal tip is concentrically positioned and disposed on the front end of the center electrode base metal, the front end being greater in diameter than the noble metal tip; then, while the noble metal tip is pressed against the front end of the center electrode base metal, welding is performed. Meanwhile, the positioning operation may involve a large error (center runout). In the case where the noble metal tip is positioned on the front end of the center electrode base metal in such a manner as to be laterally biased and the outer circumferential edge of the joint surface of the noble metal tip is laser-welded, the noble metal tip is fixed in such a manner as to be laterally biased. In this case, a weld pool is apt to exist on the outer circumferential edge of the joint surface at a position opposite the side toward which the noble metal tip is biased. Such a weld pool forms an irregular projection or mound-like protrusion which is radially higher than the other bead portion, as viewed from the front end side of the noble metal tip. That is, as a result of center runout in positioning the noble metal tip before welding, the bead may have a protrusion at a position other than the bead end.

As mentioned above, there are two types of bead protrusions, which, as viewed from the front end of the welded noble metal tip, assume the form of an irregular projection or mound-like protrusion radially higher than the other bead portion; specifically, a protrusion generated at a bead end portion (one or more protrusions; hereinafter, may be referred to as the bead end protrusion or merely as the protrusion) and a protrusion induced by a relatively large center runout which arises in concentrically positioning and disposing the noble metal tip on the front end of the center electrode base metal (hereinafter, may be referred to as the center-runout-induced protrusion or merely as the protrusion). When such a protrusion of the center electrode exists in such a manner as to face a side toward the proximal end of the ground electrode or be located close to the facing position, the frequency of generation of abnormal discharge is high.

Based on the above findings, the present invention has been accomplished, and an object of the invention is to reduce or prevent the generation of abnormal discharge across a gap other than the regular gap between a center electrode and a ground electrode in a spark plug in which the center electrode is formed by laser-welding a noble metal tip to a center electrode base metal, thereby preventing a deterioration in ignition performance.

Means for Solving the Problems

To achieve the above object, an invention described in claim 1 provides a spark plug comprising an insulation member assuming the form of a hollow shaft and having a center electrode disposed at a front end thereof, and a metallic shell surrounding the insulation member and having a ground electrode disposed at a front end thereof and adapted to form a spark gap in cooperation with the center electrode. The center electrode is formed by welding a noble metal tip to a front end of a center electrode base metal in such a manner that laser welding is performed in the circumferential direction along the circumference of a joint surface between the center electrode base metal and the noble metal tip in excess of full circumference. The spark plug is characterized in the following: when G represents a spark gap between the center electrode and the ground electrode and A represents a shortest gap between a laser weld bead and a line drawn in parallel with the axis X of the metallic shell along the inner surface of a proximal end portion of the ground electrode which faces the center electrode, G and A establish the dimensional relation $A \leqq 3G$; and, when the spark plug is viewed in the axial direction from a front end of the noble metal tip, the vertex of a protrusion formed relatively high in the radial direction in a bead formed by circumferential laser welding does not exist on a straight line which connects the center of the noble metal tip and the circumferential center of a proximal end of the ground electrode, and is located circumferentially away from the straight line.

In the present application, the front end of a spark plug refers to an end toward the side on which the center electrode or the ground electrode is provided with respect to the axial direction (longitudinal direction) of the spark plug. This also applies to a front end in terms of component members, such as the electrodes, the metallic shell, and the insulation member, and regions (or portions). The "noble metal tip" used in the electrodes of a discharge portion of the spark plug is formed typically of a simple element of Pt (platinum) or Ir (iridium), or an alloy which contains the element as a main component.

An invention described in claim 2 is a spark plug according to claim 1, wherein the protrusion exists at a plurality of positions in the circumferential direction; none of the vertexes of the protrusions exist on the straight line which connects the center of the noble metal tip and the circumferential center of the proximal end of the ground electrode; and the vertexes of the protrusions are located circumferentially away from the straight line.

An invention described in claim 3 is a spark plug according to claim 1, wherein the protrusion exists at a plurality positions in the circumferential direction; a bead portion existing within a maximum circumferential interval between two protrusions faces a side toward the proximal end of the ground electrode; and the vertexes of the two protrusions are located circumferentially away from the straight line which connects the center of the noble metal tip and the circumferential center of the proximal end of the ground electrode.

An invention described in claim 4 is a spark plug according to any one of claims 1 to 3, wherein, when the spark plug is viewed in the axial direction from the front end of the noble metal tip, the straight line which connects the center of the noble metal tip and the circumferential center of the proximal end of the ground electrode and a straight line which connects the center of the noble metal tip and the vertex of the protrusion formed relatively high in the radial direction in the bead formed by circumferential laser welding form an angle $\theta$ of 45 degrees or greater.

An invention described in claim 5 is a spark plug according to claim 4, wherein the angle $\theta$ is 90 degrees or greater.

An invention described in claim 6 is a spark plug according to any one of claims 1 to 5, wherein the ground electrode extends frontward from the front end of the metallic shell, and a distal end of the ground electrode is bent toward the noble metal tip so as to form a spark gap in cooperation with a front end surface of the noble metal tip. An invention described in claim 7 is a spark plug according to claim 6, wherein the ground electrode is chamfered in such a manner that corners formed between an inner surface of the ground electrode which faces the center electrode, and surfaces of the ground electrode which are adjacent to the inner surface are chamfered at least at portions corresponding to the length of a projecting portion of the center electrode projecting in the axial direction from the front end of the insulation member.

An invention described in claim 8 is a spark plug according to any one of claims 1 to 5, wherein the ground electrode extends frontward from the front end of the metallic shell, and a distal end of the ground electrode is bent toward the noble metal tip so as to form a spark gap in cooperation with an outer circumferential surface of the noble metal tip. An invention described in claim 9 is a spark plug according to claim 8, wherein the ground electrode is chamfered in such a manner that corners formed between an inner surface of the ground electrode which faces the center electrode, and surfaces of the ground electrode which are adjacent to the inner surface are chamfered at least over a range from a position in the axial direction corresponding to the front end of the insulation member to the distal end of the ground electrode.

An invention described in claim 10 is a spark plug according to any one of claims 1 to 9, wherein the ground electrode has a noble metal tip laser-welded thereto. An invention described in claim 11 is a spark plug according to any one of claims 1 to 10, wherein the laser welding is pulse laser welding.

An invention described in claim 12 is a method of manufacturing a spark plug comprising a step of assembling an insulation member assembly by inserting component members including a center electrode having a noble metal tip welded to a front end thereof into an insulation member in the form of a hollow shaft, and disposing component members including a terminal electrode rearward of the center electrode so as to fix the component members including the center electrode within the insulation member; a step of inserting the insulation member assembly in which the component members including the center electrode are fixedly inserted, into a tubular metallic shell having a ground electrode provided at a front end thereof, from a rear end of the metallic shell; and a crimping step of crimping the metallic shell for fixing within the metallic shell the insulation member assembly inserted into the metallic shell. The method is characterized as follows: in manufacture of the spark plug according to any one of claims 1 to 11, while the metallic shell is positioned such that the ground electrode is located at a predetermined position about the axis of the metallic shell, in a period from a stage before inserting the insulation member assembly into the metallic shell to a stage of crimping the metallic shell in the crimping step, the radial height of the bead is detected by detection means along the circumference of the noble metal tip, and, on the basis of the detected data, adjustment is made on the position of the vertex of the protrusion about the axis relative to the straight line which connects the center of the noble metal tip and the circumferential center of the proximal end of the ground electrode.

An invention described in claim 13 is a method of manufacturing a spark plug comprising a step of assembling an insulation member assembly by inserting component members including a center electrode having a noble metal tip welded to a front end thereof into an insulation member in the form of a hollow shaft, and disposing component members including a terminal electrode rearward of the center electrode so as to fix the component members including the center electrode within the insulation member; a step of inserting the insulation member assembly in which the component members including the center electrode are fixedly inserted, into a tubular metallic shell having a ground electrode provided at a front end thereof from a rear end of the metallic shell; and a crimping step of crimping the metallic shell for fixing within the metallic shell the insulation member assembly inserted into the metallic shell. The method is characterized as follows: in manufacture of the spark plug according to any one of claims 1 to 11, while the metallic shell is positioned such that the ground electrode is located at a predetermined position about the axis of the metallic shell, before the insulation member assembly is inserted into the metallic shell, the radial height of the bead is detected by detection means along a circumference of the noble metal tip, and, on the basis of the detected data, adjustment is made on the position of the vertex of the protrusion about the axis relative to the straight line which connects the center of the noble metal tip and the circumferential center of the proximal end of the ground electrode.

An invention described in claim 14 is a method of manufacturing a spark plug according to claim 12 or 13, wherein the detection means is implemented by processing an image captured by a camera. An invention described in claim 15 is a method of manufacturing a spark plug according to claim 12 or 13, wherein the detection means is implemented by laser measurement.

Effects of the Invention

As mentioned above, when the noble metal tip is laser-welded to the front end surface of the center electrode base metal in such a manner that laser welding is performed around the joint surface therebetween in the circumferential direction in excess of full circumference, the final end portion (end-point portion) of the weld bead assumes the form of an irregular projection or mound-like protrusion which is radially higher than the circumferentially other portion of the bead. When a spark plug is viewed in the axial direction from the front end of the noble metal tip, if the vertex of the protrusion exists on the straight line which connects the center of the noble metal tip and the circumferential center of the proximal end of the ground electrode, the distance between the protrusion and a portion of the ground electrode located toward the proximal end of the ground electrode becomes the shortest. Further, electric field is likely to concentrate at the protrusion, and thus an abnormal discharge is likely to be generated. Under the circumstances, when the dimensional relation $A \leqq 3G$ is established, where G is a spark gap (dimension) and A is the shortest gap (dimension) between the laser weld bead and a line drawn in parallel with the axis of the metallic shell along the inner surface of a proximal end portion of the ground electrode which faces the center electrode, an abnormal discharge is likely to be generated, particularly when the spark plug is mounted to a cylinder head in such an arrangement that a swirl flow flows in the direction from the center electrode to the proximal end of the ground electrode.

By contrast, the spark plug according to the invention described in claim 1 of the present application has the dimensional relation $A \leqq 3G$. When the spark plug is viewed in the direction of the axis (the axis of the plug) from the front end of the noble metal tip, the vertex of a protrusion formed relatively high in the radial direction in the bead formed by circumferential laser welding does not exist on the straight line which connects the center of the noble metal tip and the circumferential center of the proximal end of the ground electrode, and is located circumferentially away from the straight line. Thus, the generation of abnormal discharge can be effectively prevented or reduced. As a result, the invention of the present application can enhance the sparking rate across the regular gap and thus can yield a quite important effect of improving fuel ignition performance. In view of prevention of the generation of abnormal discharge, preferably, the spark plug is assembled such that the vertex of a protrusion formed relatively high in the radial direction at the final end portion of a bead is located circumferentially away from the straight line to the greatest possible extent.

In assembly of such a spark plug, after the insulation member having the center electrode to which the noble metal tip is welded is inserted into the tubular metallic shell having the ground electrode at the front end thereof, it is good practice to make sure of the position of the vertex of the protrusion at the final end portion of a bead as viewed in the axial direction from the front end of the noble metal tip. That is, it is confirmed that, as viewed in such a manner, the vertex does not exist on the straight line which connects the center of the noble metal tip and the circumferential center of the proximal end of the ground electrode, but is located circumferentially away from the straight line. Specifically, the spark plug may be assembled as follows: the insulation member in which the center electrode, etc. are fixed is turned about the axis thereof by an appropriate angle within the metallic shell such that the vertex of the protrusion at the final end portion of the bead does not face a side toward the proximal end of the ground electrode, but preferably faces a side opposite the proximal end, and, in this condition, the insulation member is fixed to the metallic shell.

As mentioned above, a plurality of the protrusions are formed by laser welding from a plurality of directions by use of a plurality of laser welding machines. For example, a bead end protrusion is formed at two positions when laser irradiation is performed from two directions by use of two laser welding machines disposed at two circumferentially opposite positions as follows: the center electrode base metal is turned about the axis by, for example, 135 degrees, and, in the course of the turn, pulse welding is performed an appropriate number of times. In such a case, in the course of assembling a spark plug, positional relation may be determined as follows: as described in claim 2, neither of the vertexes of two protrusions existing in the circumferential direction exist on the straight line which connects the center of the noble metal tip and the circumferential center of the proximal end of the ground electrode, and the vertexes of the protrusions are located circumferentially away from the straight line. In this case, preferably, a bead portion formed relatively low in the radial direction between the two protrusions (preferably a circumferentially middle portion between the two protrusions or a portion located toward the circumferentially middle point between the two protrusions) exists on the straight line which connects the center of the noble metal tip and the circumferential center of the proximal end of the ground electrode. A protrusion is formed at three positions when laser irradiation is performed from three directions by use of three laser welding machines disposed at circumferentially equal angular intervals as follows: the center electrode base metal is turned about the axis by, for example, 80 degrees. In this case, preferably, a bead portion formed relatively low in the radial direction between any two protrusions (preferably a circumferentially middle portion between the two protrusions or a portion located toward the circumferentially middle point between the two protrusions) exists on the straight line which connects the center of the noble metal tip and the circumferential center of the proximal end of the ground electrode.

As mentioned above, the number of bead end protrusions varies with the number of directions from which laser welding is performed; i.e., with the number of weld beads. In the case where laser welding is performed circumferentially from a plurality of directions by use of a plurality of laser welding machines, the welding range (circumferentially angular range) is basically the same among the laser welding machines. Thus, the circumferential length of a bead depends on the number of laser welding machines to be used; usually, the circumferential length of a bead is obtained by dividing the outer circumference (full circumference) of the noble metal tip at equal angular intervals. Therefore, bead end protrusions are arranged at substantially equal circumferential intervals (angular intervals). Meanwhile, a center-runout-induced protrusion is not generated or is ignorable when positioning accuracy is high. Thus, even when a center-runout-induced protrusion is ignorable, in the case where a plurality of bead end protrusions exist, the protrusions may be positioned as follows: the positional relation of the protrusions with the proximal end of the ground electrode is, as described in claim 2, such that the vertexes of the protrusions are located circumferentially away from the aforementioned straight line.

Meanwhile, a center-runout-induced protrusion is generated irrespective of the number and position of bead end protrusions. Therefore, regardless of whether welding is performed from a single or a plurality of directions, two protrusions may be generated in proximity to each other. In such a case, the protrusions may be positioned as follows: as in the case of the invention described in claim 3, a bead portion corresponding to the maximum circumferential interval between two protrusions faces a side toward the proximal end of the ground electrode; and the vertexes of the two protrusions are located circumferentially away from the straight line which connects the center of the noble metal tip and the circumferential center of the proximal end of the ground electrode. The expression "a bead portion existing within the maximum circumferential interval between two protrusions faces a side toward the proximal end of the ground electrode" encompasses the case where the bead portion exists on the straight line which connects the center of the noble metal tip and the circumferential center of the proximal end of the ground electrode. More preferably, the vertexes of the two protrusions are located in circumferentially opposite directions from the straight line at substantially the same or the same interval (angle) from the straight line. That is, the positional relation in which the straight line passes a middle portion between the two vertexes is preferred.

According to the present invention, the vertex of the protrusion at the final end portion of a bead is located such that, as described in claim 4, the angle θ is held at 45 degrees or greater, thereby yielding the effect of preventing the generation of abnormal discharge, and such that, as described in claim 5, the angle θ is held at 90 degrees or greater, thereby rendering the generation of abnormal discharge substantially nil.

The present invention can be embodied as described in claims 6 and 8 not only in a spark plug in which the spark gap is formed between the ground electrode and the front end surface of the noble metal tip of the center electrode but also in a spark plug in which the spark gap is formed between the ground electrode and the outer circumferential surface of the noble metal tip of the center electrode. In these spark plugs, as described in claims 7 and 9, the corners of the ground electrode are chamfered so as to remove sharp edges from the corners; thus, the generation of concentration of electric field can be reduced accordingly, thereby enhancing further the effect of reducing or preventing the generation of abnormal discharge. In the spark plugs mentioned above, in view of enhancing resistance to spark-induced erosion, preferably, the noble metal tip is also welded to the ground electrode base metal to form the ground electrode.

MODES FOR CARRYING OUT THE INVENTION

Figure 1:
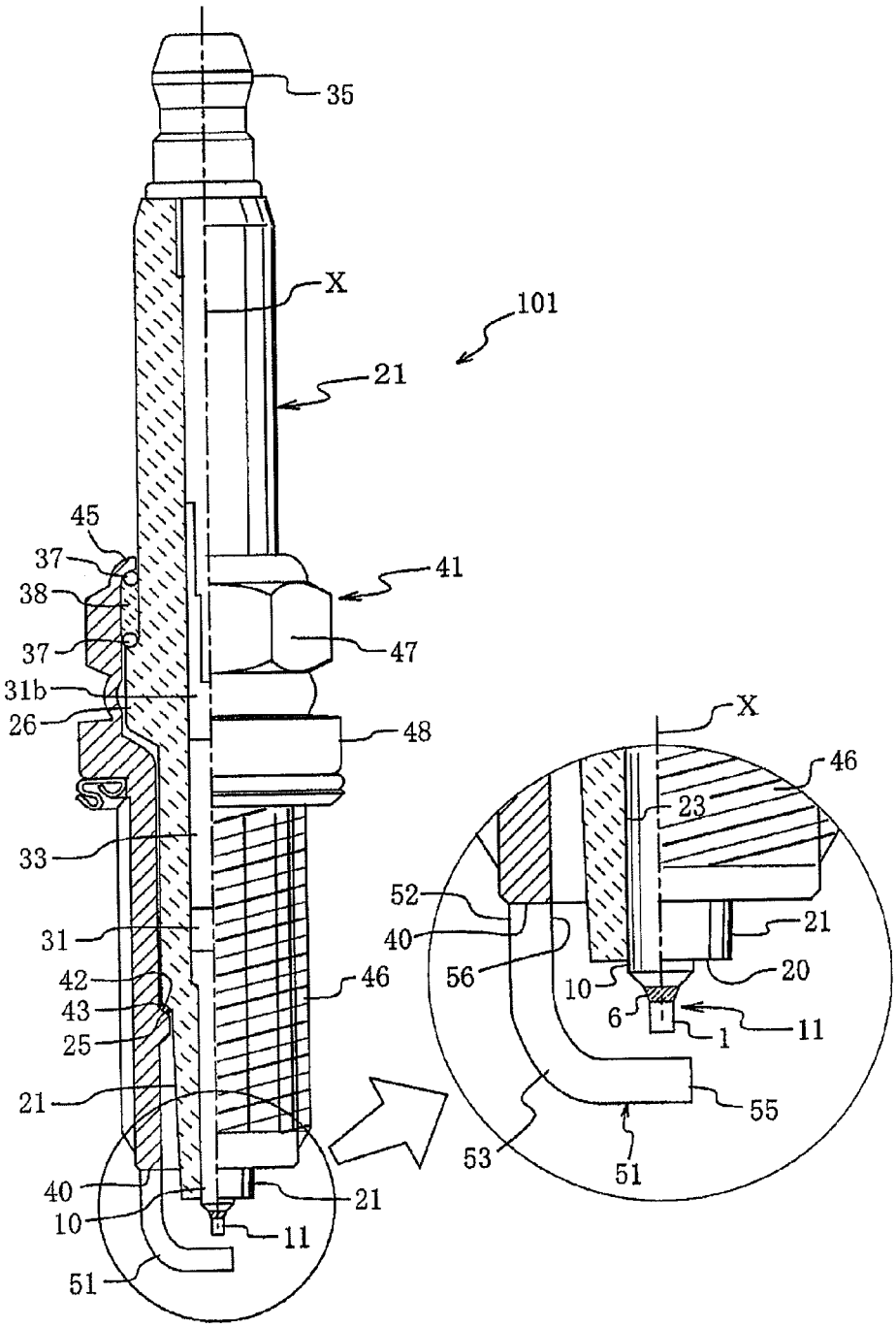
[FIG. 1] Vertical sectional view for explaining the overall configuration of a spark plug, and enlarged view showing essential portions (front end portion) of the spark plug.
Figure 2:
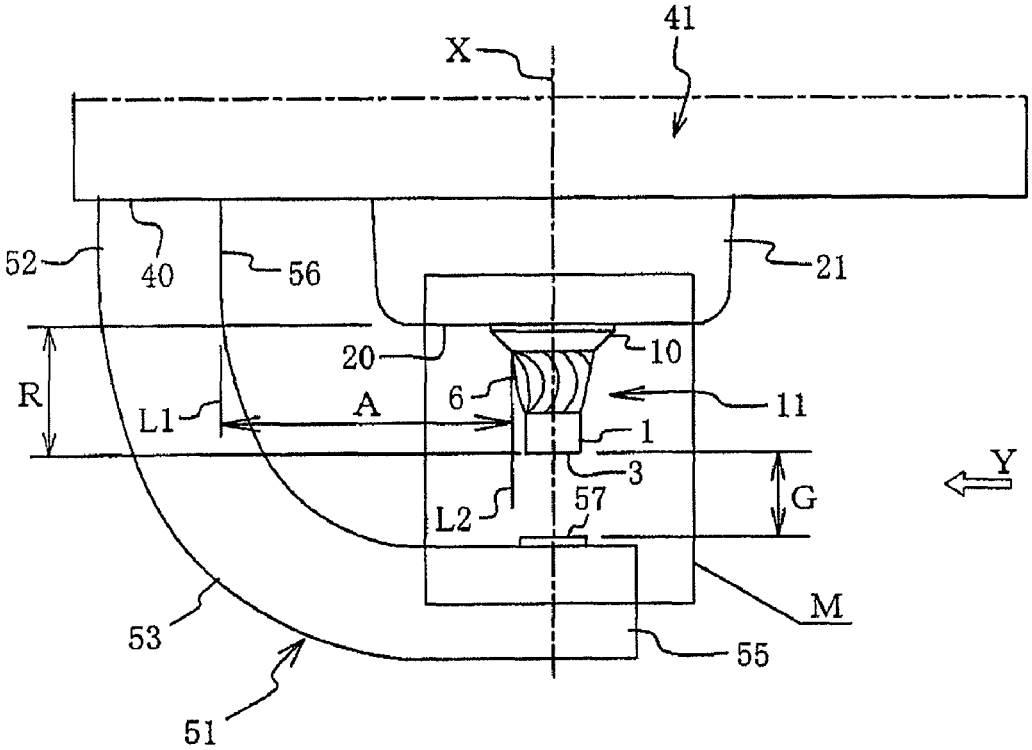
[FIG. 2] Further enlarged view showing the essential portions (front end portion) of the spark plug.

A spark plug according to an embodiment of the present invention will be described in detail with reference to FIGS. 1 to 6. First, the overall configuration of the spark plug of the present embodiment is described. Since the spark plug and its component members, such as a metallic shell and an insulation member (ceramic insulator), are similar in material and basic constitution to publicly known ones, description thereof is brief. FIG. 1 is a vertical half-sectional view for explaining the overall configuration of a spark plug 101, accompanied by an enlarged view showing essential portions (front end portion) of the spark plug 101. FIG. 2 is a further enlarged view showing the essential portions (front end portion) of the spark plug 101.

As shown in FIG. 1, the spark plug 101 of the present embodiment is composed primarily of a ceramic insulation member 21 which assumes the form of a hollow shaft and in which a center electrode 11 having a noble metal tip 1 welded thereto projects from a front end 20, and a tubular metallic shell 41 which fixedly surrounds the insulation member 21 and has a ground electrode 51 provided at a front end 40. The spark plug 101 is configured as follows.

A center electrode base metal 10 is fixed by means of seal glass 31 within a central axial hole 23 of the insulation member 21 in such a manner as to project from the front end (lower end in FIG. 1) 20 of the insulation member 21. A terminal electrode 35 is located rearward (upward in FIG. 1) of the seal glass 31 via a resistor 33 and is fixed by means of seal glass 31*b* in such a manner that the rear end (upper end in FIG. 1) of the terminal electrode 35 projects from the rear end of the insulation member 21. The insulation member (hereinafter, may be referred to as the insulation member assembly) 21 in which the center electrode 11, etc. are fixed is inserted into the metallic shell 41 from the rear end of the metallic shell 41, whereby the spark plug 101 is assembled as follows.

Figure 4:
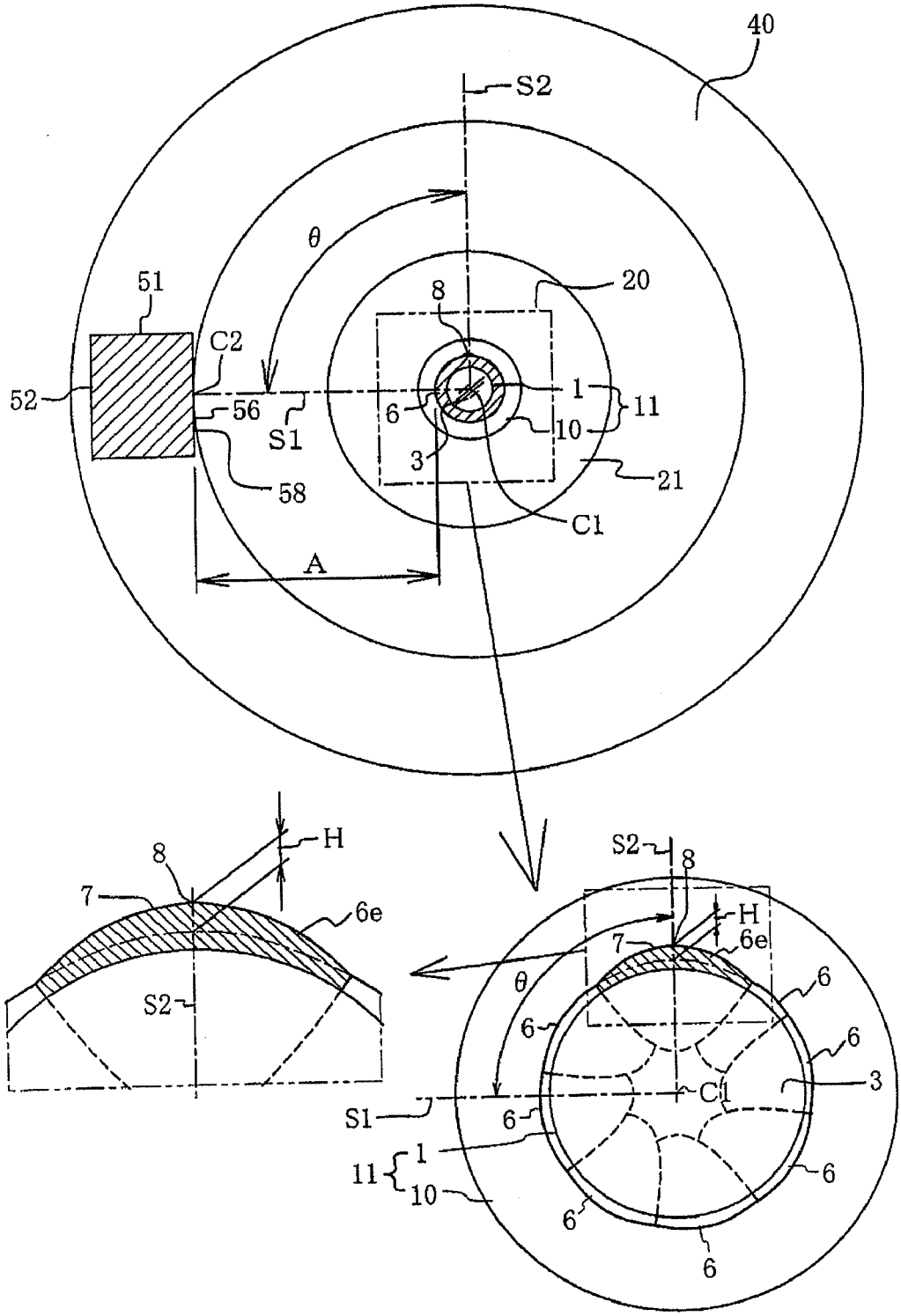
[FIG. 4] View of FIG. 3 as cut at the proximal end of a ground electrode, and enlarged view schematically showing a weld bead of a center electrode.
Figure 5:
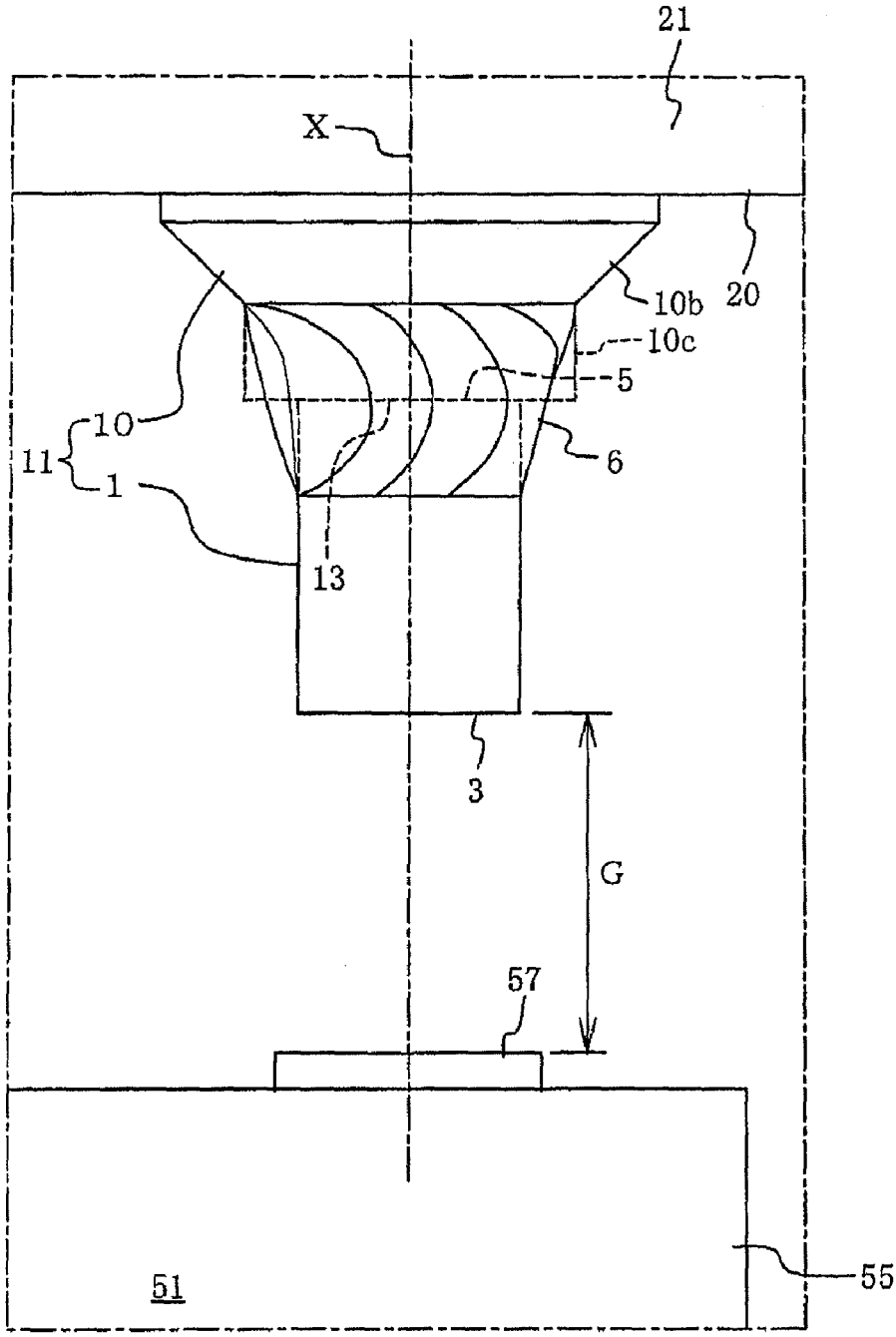
[FIG. 5] Enlarged view of area M of FIG. 2.

The above-mentioned insertion is performed such that a front-facing surface (annular stepped portion) 25 of a portion of the insulation member (insulation member assembly) 21 located toward the front end 20 is pressed, via a packing 43, against a rear-facing surface (engagement flange) 42 formed at a portion of the inner surface of the metallic shell 41 located toward the front end of the metallic shell 41. Next, in the present embodiment, an O ring 37, talc 38, and an O ring 37 are disposed between an intermediate portion of the insulation member 21 located rearward of a radially outward projecting fixation flange 26 of the insulation member 21 and the inner surface of a rear large-diameter tubular portion of the metallic shell 41. Subsequently, a crimp cylinder portion 45 at the rear end of the metallic shell 41 is bent inward and is plastically deformed through frontward compression. By this procedure, the insulation member 21 in which the center electrode 11, etc. are fixed is fixed within the metallic shell 41, whereby the spark plug 101 is assembled. The thus-assembled spark plug 101 is screwed into a plug hole (threaded hole) of an unillustrated cylinder head via a mounting screw 46 provided on the outer circumferential surface of a front portion of the metallic shell 41 by use of a plug wrench or a like tool engaged with a screwing polygonal portion 47 of the metallic shell 41, whereby, while a seating ring flange portion 48 of the metallic shell 41 is pressed against a seat surface of the cylinder head, the spark plug 101 is mounted to the cylinder head Next will be described an electrode portion which is located at the front end of the spark plug 101 and serves as the gist of the present invention (see FIGS. 1 to 6). In the present embodiment, the center electrode 11 is provided in the insulation member 21 made of ceramic and having the form of a hollow shaft (the form of a tube) in such a manner that the front end of the center electrode 11 projects from the center of the front end 20 of the insulation member 21. As shown in FIGS. 1, 2, and 5, the center electrode 11 includes the circular columnar center electrode base metal 10, which, except for its front end portion, is accommodated in the insulation member 21, and the circular columnar noble metal tip 1 (outside diameter 0.6 mm, length 0.8 mm), which is welded to a front end surface 13 of the center electrode base metal 10 and has an outside diameter (0.6 mm) smaller than that (2.0 mm) of the center electrode base metal 10. The center electrode base metal 10 and the noble metal tip 1 are laser-welded together as described below. Notably, although not illustrated, a center rod formed of a copper alloy is disposed in the center electrode base metal 10. In the present example, the center electrode base metal 10 and the ground electrode 51 are formed of an Ni-based heat-resistant alloy, such as INCONEL 600 (trademark of Inconel Co., Ltd.), or an Fe-based heat-resistant alloy. Further, the noble metal tip 1 is formed of an alloy which contains P1 or Ir as a main component, and is a publicly known noble metal tip used in the spark plug 101.

Meanwhile, as shown in FIG. 2, the ground electrode 51 is welded to a front end 40 of the tubular metallic shell 41. A portion of the ground electrode 51 which is located toward a proximal end (root) 52 of the ground electrode 51 extends frontward (downward in FIGS. 1 and 2) from the front end 40 of the metallic shell 41 along an axis X of the metallic shell 41 and the insulation member 21. A portion of the ground electrode 51 which is located toward a distal end 55 of the ground electrode 51 is bent toward the center electrode 11 via an arcuate portion 53. In the present example, a noble metal tip (disk) 57 is welded to a surface of the distal end 55 of the ground electrode 51 which is continuous to an inner surface 56 of the proximal end 52 which faces the center electrode 11, and the noble metal tip 57 forms a regular gap G in cooperation with a front end surface 3 of the noble metal tip 1 of the center electrode 11 (see FIGS. 2 and 5). The gap G is set to 0.7 mm to 1.3 mm. As shown in FIG. 4, the ground electrode 51 has a rectangular cross-sectional shape and has substantially the same cross section over a range from the proximal end (root) 52 to the distal end. The ground electrode 51 is fixedly disposed on the front end (annular portion) 40 of the metallic shell 41 such that, as viewed from the front end 40 of the metallic shell 41, a long side 58 of the rectangle is tangent to the circumferential direction (see FIG. 4). As shown in FIG. 2, a shortest gap (distance) A (hereinafter, may be referred to as the gap A), as measured perpendicularly to the axis X, between a line L1 drawn in parallel with the axis X of the metallic shell 41 and of the spark plug 101 along the inner surface 56 of the proximal end 52 or a portion located toward the proximal end 52 of the ground electrode 51 and the surface of a bead 6 of welding the center electrode base metal 10 and the noble metal tip 1 together is determined so as to establish the dimensional relation $A \leqq 3G$. A is specifically 1.3 mm to 3.9 mm inclusive.

In the present embodiment, as shown in FIG. 5, a front end portion of the center electrode base metal 10 is formed into a circular columnar portion 10*c* having a diameter of 0.9 mm and shown by the broken line in FIG. 5, via a truncated cone portion 10*b* which is tapered frontward; and, the noble metal tip 1 is laser-welded to the front end surface 13 of the circular columnar portion 10*c*. FIG. 5 shows a form after welding; i.e., after welding, the circumferential surface of the circular columnar portion 10*c* assumes the form of the bead 6. In this welding, an end surface 5 of the noble metal tip 1 is positioned and disposed on the front end surface 13 of the center electrode base metal 10, and the outer circumferential edges of the joint surfaces 5 and 13 of the two members are welded together in the circumferential direction along a circumferential length (angle) of full circumference (360 degrees)+α degrees (see FIG. 6). As shown exaggeratingly in FIGS. 4 and 6, a final end portion 6*e* (see FIG. 4 and an upper portion of FIG. 6) of the weld bead 6 assumes the form of a protrusion (hatched in FIGS. 4 and 6) 7, which is formed (mounded) an amount H higher in the radial direction than the other beads 6. As viewed from the direction of the axis X, the circumferential center of the protrusion 7 is a vertex 8 which projects maximally radially outward. In the present example, the bead 6 has a width ranging from 0.4 mm to 0.8 mm and a depth ranging from 0.1 mm to 0.3 mm. The height (maximum projection height) of the protrusion 7 as viewed from the front end 3 of the noble metal tip 1; i.e., the amount H which the protrusion 7 projects radially outward more than do the other beads 6, is about 0.03 mm to 0.2 mm.

In the present embodiment, when the spark plug 101 is viewed in the direction of the axis X from the front end 3 of the noble metal tip 1, the protrusion 7 of the final end portion (end point) 6*e* of the bead 6 is disposed as follows: a straight line S1 which connects a center C1 (axis X) of the noble metal tip 1 and a circumferential center C2 of the proximal end 52 (long side 58 of the rectangle) of the ground electrode 51 and a straight line S2 which connects the center C1 of the center electrode 11 (noble metal tip 1) and the vertex 8 of the protrusion 7 at the final end portion (end point) 6*e* of the circumferential bead 6 form an angle θ of 90 degrees (see FIGS. 4 and 6). That is, in the present embodiment, not only does the vertex 8 of the protrusion 7 at the final end portion (end point) 6*e* of the circumferential bead 6 not exist on the straight line S1 which connects the center C1 of the center electrode 11

Figure 6:
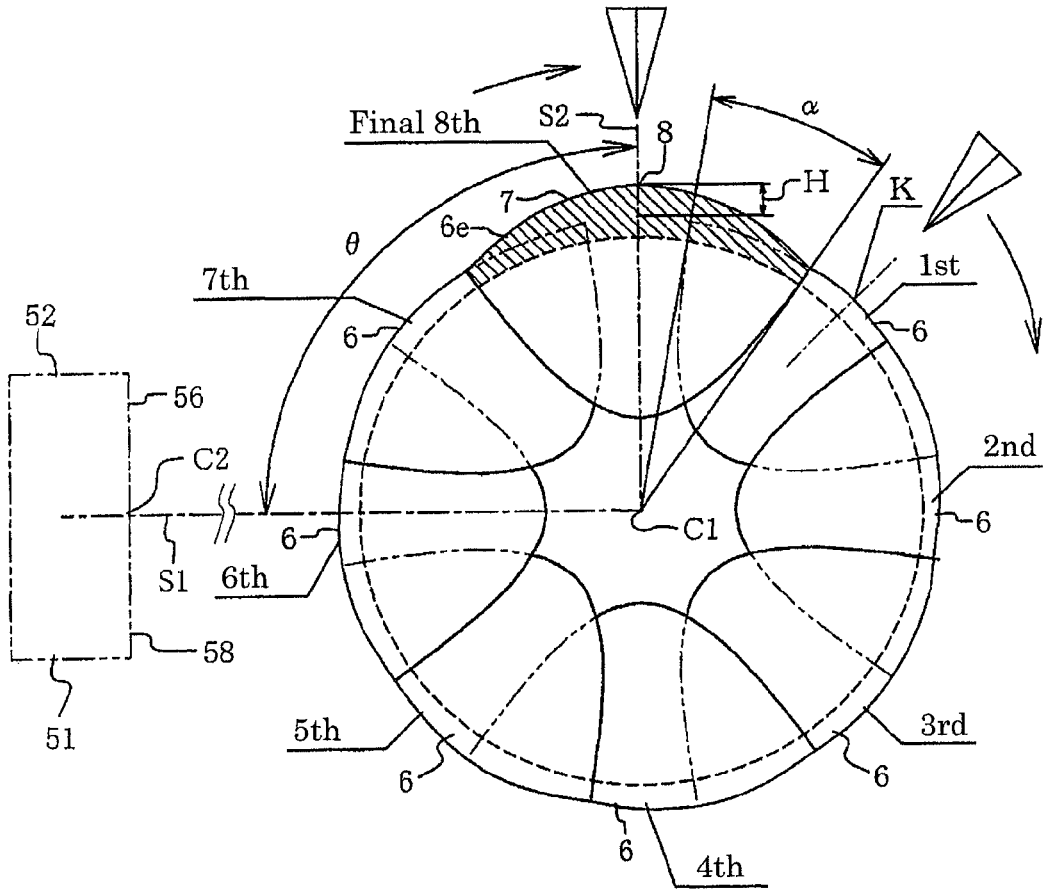
[FIG. 6] View from the front end of a noble metal tip for explaining a welding step for the noble metal tip of the center electrode.

(noble metal tip 1) and the circumferential center C2 of the proximal end 52 (width of the long side 58) of the ground electrode 51, but also the vertex 8 of the protrusion 7 is intentionally located an angle θ of 90 degrees circumferentially away from the straight line S1 as shown in FIGS. 4 and 6. Through employment of such a configuration, the present embodiment yields the following particular effect: the generation of abnormal discharge between a portion of the ground electrode 51 located toward the proximal end 52 and the bead 6 formed through welding of the noble metal tip 1 can be prevented or reduced.

According to the present embodiment, the vertex 8 of the protrusion 7 at the final end portion (end point) 6*e* of the circumferential bead 6 is disposed circumferentially 90 degrees away from the straight line S1. However, even when the angle θ is smaller than 90 degrees, such as 45 degrees or 60 degrees, according to the dimensional relation between the lateral gap A and the regular gap G which depends on the size and type (mounting screw diameter) of the spark plug, the effect of preventing the generation of abnormal discharge is yielded in accordance with the given angle θ. This is because the dimensional relation between the regular gap (dimension) G and the above-mentioned shortest gap A, as measured perpendicularly to the axis X, between the line L1 drawn in parallel with the axis X along the inner surface 56 of the proximal end 52 or of a portion located toward the proximal end 52 of the ground electrode 51 and the surface of the bead 6 of welding the center electrode base metal 10 and the noble metal tip 1 together depends on the type or thread size (mounting screw diameter) of the spark plug. That is, in a spark plug whose mounting screw 46 has a relatively large diameter, the dimension A itself is relatively large; thus, even though the angle θ is small, abnormal discharge is essentially unlikely to be generated. By contrast, in a spark plug whose mounting screw diameter is small, the lateral gap A is basically small; thus, abnormal discharge is likely to be generated. Therefore, when the present invention is embodied in a spark plug whose mounting screw diameter is small, also in view of workability of assembling the spark plug, preferably, the angle θ is set to a relatively large angle of 90 degrees to 180 degrees.

The spark plug 101 of the present embodiment is assembled in the following procedure. In assembling the spark plug 101, as aforesaid, first, as practiced conventionally, component members including the center electrode 11 having the noble metal tip 1 welded to the front end thereof are inserted into the insulation member 21, and other relevant operations are performed, thereby yielding an insulation member assembly. What is important is an inspection before crimping the crimp cylinder portion 45 located at the rear end of the metallic shell 41 into which the insulation member assembly has been inserted from the rear end of the metallic shell 41 as mentioned above. Specifically, before the crimping operation, it is confirmed whether or not the vertex 8 of the protrusion 7 at the final end portion 6*e* of the bead 6 formed through welding of the noble metal tip 1 is located a desired angle θ about the axis X away from the distal end 52 of the ground electrode 51. If the protrusion 7 is not located at the desired position, the insulation member assembly is turned appropriately about the axis X within the metallic shell 41 so as to bring the protrusion 7 to the position which is located the desired angle θ away from the proximal end 52. That is, after confirming that the protrusion 7 is located at the desired position, finally, the crimp cylinder portion 45 is crimped so as to fix the insulation member assembly within the metallic shell 41.

Next, laser-welding the noble metal tip 1 to the front end surface 13 of the center electrode base metal 10 will be described in detail (see FIGS. 5 and 6). This welding operation may be performed as follows: before the center electrode base metal 10 is assembled to the insulation member 21, the end surface 5 of the noble metal tip 1 is positioned and disposed on the front end surface 13 of the center electrode base metal 10; then, the outer circumferential edges of the joint surfaces (portions) of the two members are circumferentially welded together by a publicly known laser welding process. Specifically, this welding operation is performed as shown in FIG. 6. Pulse laser irradiation, for example, is repeated a plurality of times (in FIG. 6, eight shots) on the outer circumferential edges of the joint surfaces of the two members as follows: pulse laser welding starts from the welding start point (point K located at the upper right in FIG. 6) and is performed sequentially at equal angular intervals (45-degree intervals in FIG. 6) along the circumferential direction (clockwise in FIG. 6) such that the bead 6 formed by one shot of pulse laser welding overlaps the bead 6 formed by the next shot of pulse laser welding. In this manner, the outer circumferential edges of the joint surfaces (portions) of the two members are circumferentially welded together. At this time, welding is performed such that a series of the beads 6 extends along a circumferential length of full circumference (360 degrees)+α degrees; i.e., a bead 6*e* formed by the eighth shot (final shot) of a pulse laser overlaps, in the amount of the angle α as viewed from the direction of the axis X, the bead formed by a pulse laser which has been shot as the first shot with point K serving as the center. By welding in such a manner, in contrast to the other beads, no bead is formed on the bead 6*e*, which is a final (end point) weld portion. Therefore, as shown exaggeratingly in FIG. 6, the final bead 6*e* is formed such that, when the spark plug 101 is viewed in the direction of the axis X from the front end 3 of the noble metal tip 1, the protrusion (mound) 7 which projects radially outward the amount H more than do the other beads 6 is formed unavoidably. In other words, the protrusion 7 is located at the final end portion of a bead. In the case of a bead formed by a pulse laser, as viewed in the direction of the axis X, the vertex 8 is located at the center of the protrusion 7.

Next, samples of the spark plug 101 which differed in the angle θ between the straight line S1 and the straight line S2 in FIGS. 4 and 6 (the angle θ was varied in a range of 0 to 120 degrees). The samples were disposed within a pressure chamber and were subjected to a spark discharge test. The spark discharge test was carried out 100 times on each of the samples under a pressure of 0.4 MPa. In this test, the number of occurrences of abnormal discharge (lateral sparking) across a gap other than the regular gap G was counted, thereby obtaining the incidence of abnormal discharge and examining the relation between the incidence and the angle θ. Basically, the likelihood of generation of abnormal discharge varies depending on the dimensional relation between the regular gap G and the lateral gap A; therefore, the samples were classified into four different dimensional relations between the gaps G and A and were tested under the classification.

Figure 3:
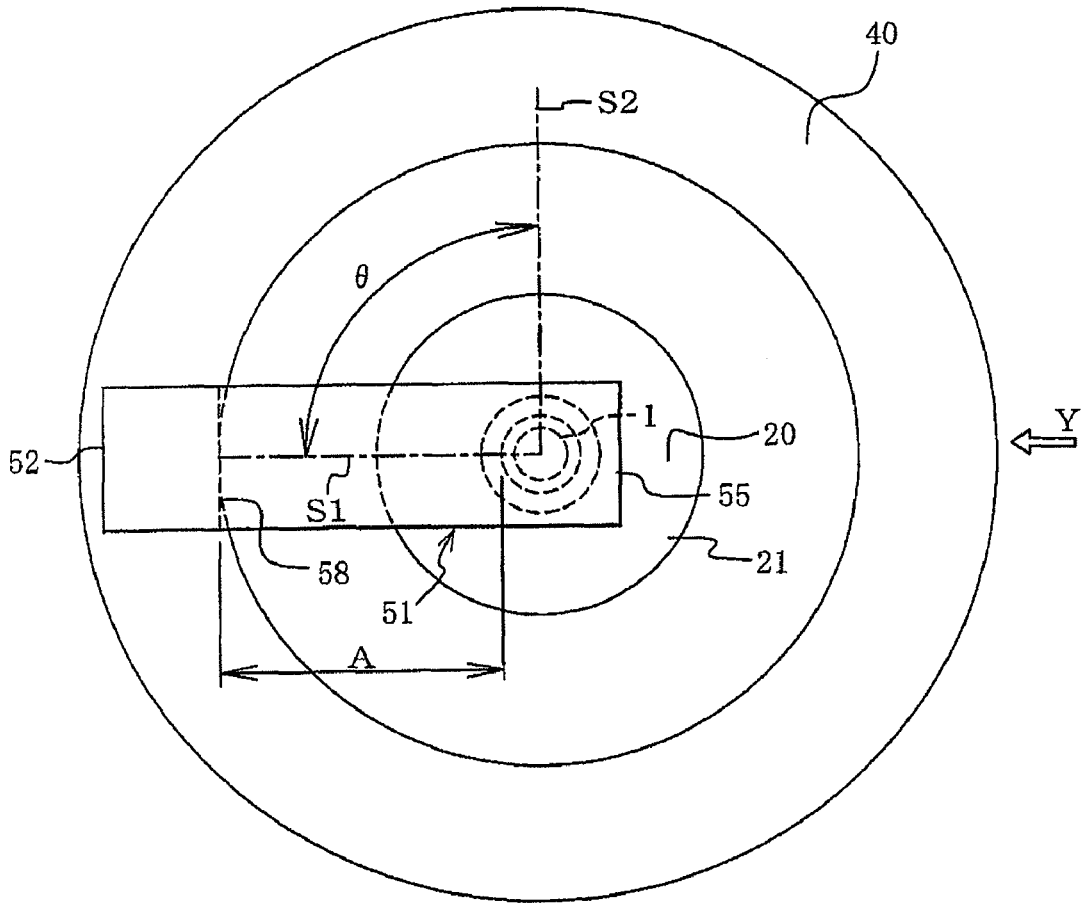
[FIG. 3] View showing the front end portion of FIG. 2 as viewed from the front end of the spark plug.
Figure 14:
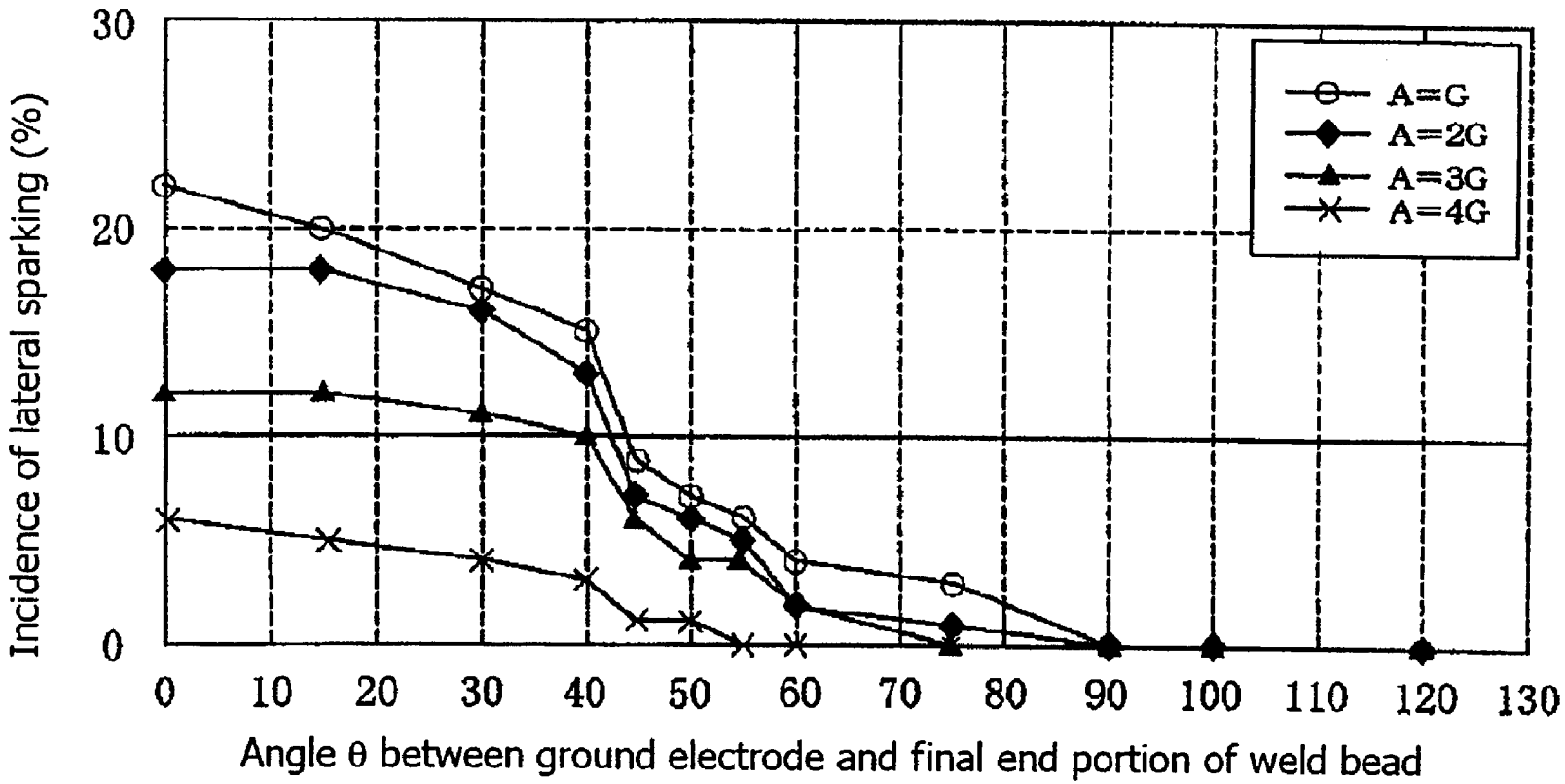
[FIG. 14] Graph showing test results of incidence of lateral sparking (%) as a function of Angle θ between ground electrode and final end portion of weld bead.

In this test, a gas flow at a speed of 7.0 m/sec was applied in the direction of arrow Y in FIGS. 2 and 3 (the direction from the center electrode 11 to the ground electrode 51) for carrying out the test in an atmosphere in which abnormal discharge is apt to be generated. The four dimensional relations between the regular gap G and the lateral gap A are as follows: A=G, A=2G, A=3G, and A=4G. These dimensional relations correspond to the mounting screw diameters of the spark plug 101 of M8, M10, M12, and M14 in the ascending order of the lateral gap A. FIG. 14 shows the test results.

As shown in FIG. 14, irrespective of the dimensional relation between G and A, as the angle (θ) increases, the incidence of lateral sparking does not increase, but decreases almost without fail. The test results prove the effect of the present invention. Particularly, in the case of the spark plug 101 whose mounting screw has a small diameter, such as the samples of A=G, A=2G, and A=3G, the incidence of abnormal discharge (lateral sparking) decreases greatly at an angle (θ) of 45 degrees. Therefore, the present invention is quite effective in application to the spark plug 101 having such a small diameter on condition that the angle (θ) is 45 degrees or the like. Further, in the case of an angle (θ) of 90 degrees, any sample including the sample with A=G exhibited an incidence of 0. That is, according to the present invention, the spark plug 101 which is assembled at an angle (θ) of 90 degrees or greater can be free from the generation of abnormal discharge, which could otherwise result from the protrusion 7 at the final end portion of a bead. Therefore, the spark plug of the present invention yields an excellent effect of reliably enhancing the percentage of sparking across the regular gap G and reliably improving fuel ignition performance.

Figure 7:
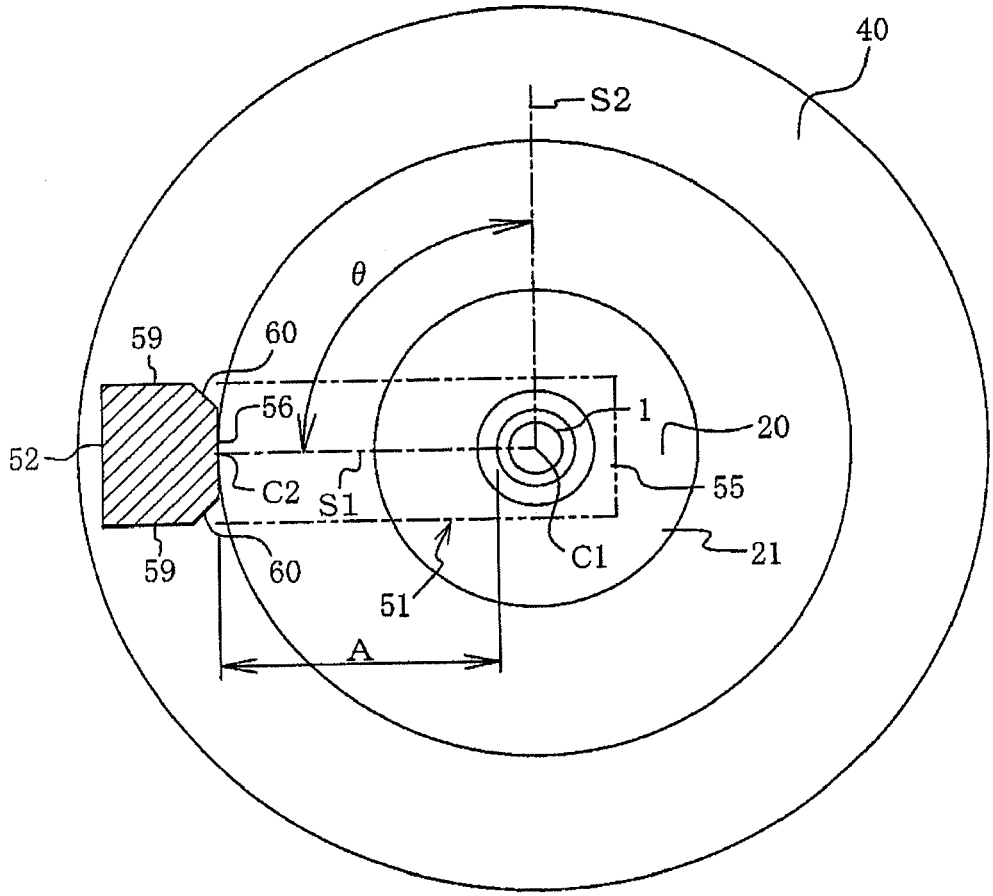
[FIG. 7] Sectional view for explaining chamfering on corners associated with the inner surface of a portion of the ground electrode located toward the proximal end of the ground electrode.

In the present invention, in order to further enhance the effect, preferably, the ground electrode 51 has the following constitution. In the above embodiment, the ground electrode 51 is formed in such a manner as to extend frontward from the front end 40 of the metallic shell 41 and such that the distal end 55 thereof is bent toward the noble metal tip 1 so as to form the spark gap (regular gap) G in cooperation with the front end surface 3 of the noble metal tip 1 of the center electrode 11. In the ground electrode 51 having such constitution, it is good practice to impart chamfers 60 to respective corners formed between the inner surface 56, which faces the center electrode 11, and two surfaces 59 which are located on opposite sides of the inner surface 56 (see FIG. 7), at least at portions (region R in FIG. 2) corresponding to the length of a projecting portion of the center electrode 11 projecting in the direction of the axis X from the front end 20 of the insulation member 21. By virtue of impartment of the chamfers 60, concentration of electric field on the corners is unlikely to arise; thus, the generation of abnormal discharge can be prevented more effectively. The chamfers 60 are not limited to a flat chamfer and a rounded chamfer and are preferably as large as possible. Also, preferably, the corners are chamfered over as long a region (range) as possible along the direction in which the ground electrode 51 extends.

The present invention is not limited to the above embodiment, but may be embodied in an appropriately modified form without departing from the gist of the invention. For example, in the spark plug 101 of the above embodiment, the noble metal tip is welded to each of the center electrode and the ground electrode. However, the present invention can be applied widely to spark plugs in which the noble metal tip is welded only to the center electrode.

Further, in the above embodiment, the present invention is embodied in the spark plug 101 having such an electrode structure that the ground electrode 51 extends frontward from the front end 40 of the metallic shell 41 and the distal end 55 of the ground electrode 51 is bent toward the noble metal tip 1 so as to form the spark gap G in cooperation with the front end surface 3 of the noble metal tip 1 of the center electrode 11. However, the present invention is not limited to a spark plug having such a spark gap.

Figure 8:
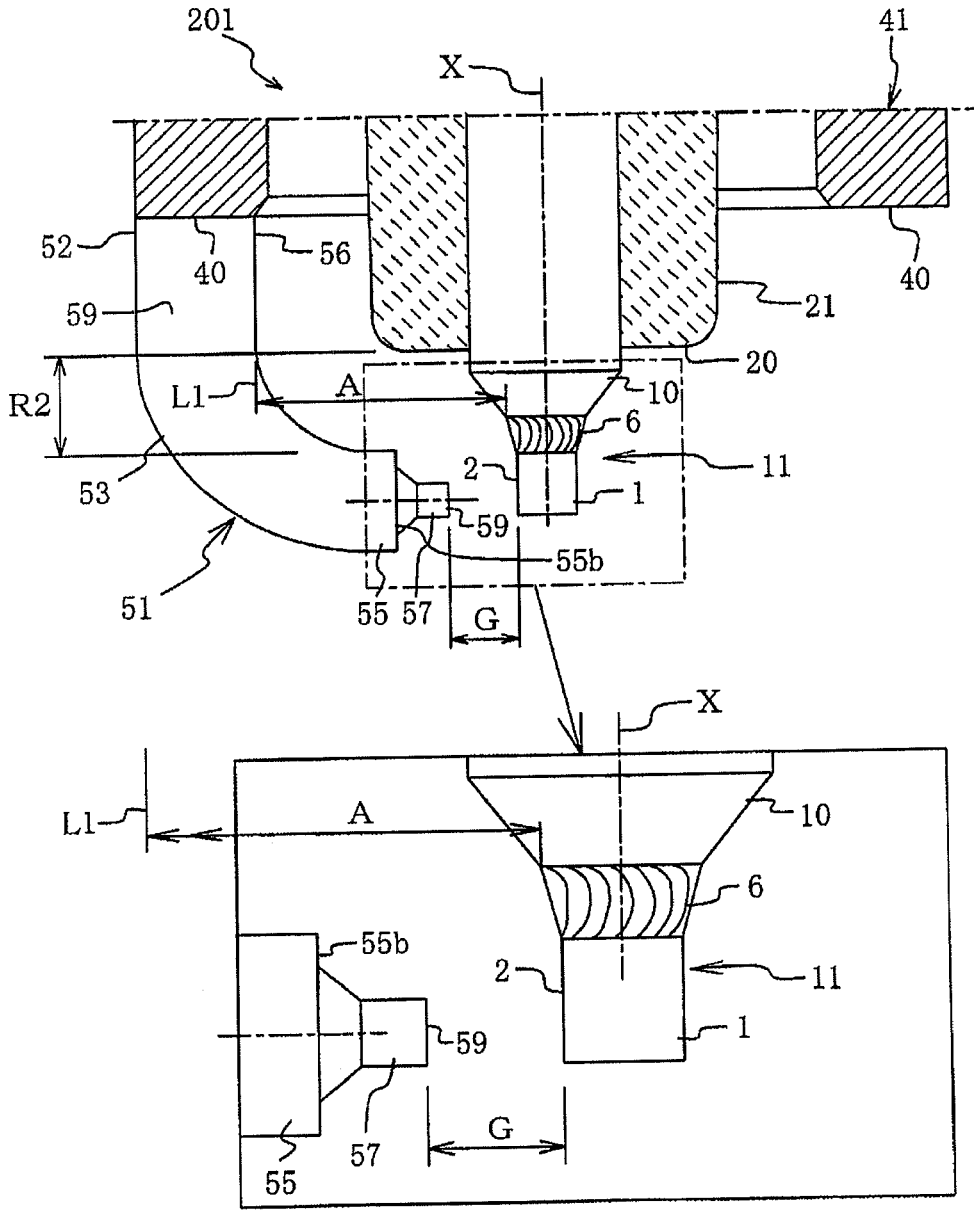
[FIG. 8] Fragmentary, enlarged view for explaining another embodiment of a spark plug.

For example, the present invention can be embodied in a spark plug 201 of FIG. 8 having such an electrode structure that the ground electrode 51 extends frontward from the front end 40 of the metallic shell 41 and the distal end 55 of the ground electrode 51 is bent toward the noble metal tip 1 so as to form the spark gap G in cooperation with an outer circumferential surface 2 of the noble metal tip 1 of the center electrode 11. That is, in the spark plug 201, the proximal end 52 of the ground electrode 51 extends frontward from the front end 40 of the metallic shell 41 along the direction of the axis X; the distal end 55 of the ground electrode 51 is bent toward the axis X of the center electrode 11 via the intermediate arcuate portion 53; and the spark gap G is formed between the bent distal end 55 of the ground electrode 51 and the outer circumferential surface 2 of the noble metal tip 1 of the center electrode 11. In the spark plug 201 shown in FIG. 8, the ground electrode 51 also has a noble metal tip 59 welded to the distal end 55 thereof.

The spark plug 201 having such a structure of the spark gap G also involves the problem of abnormal discharge as in the case of the spark plug 101 described above for the following reason: since the center electrode 11 includes the center electrode base metal 10 and the noble metal tip 1 welded to the front end of the center electrode base metal 10, the bead 6 formed by the welding operation exists. Apparently, the present invention is also effective in application to the spark plug 201 having such a structure of the spark gap G. Also, in the spark plug 201, preferably, the chamfers 60 mentioned above are imparted to respective corners of the ground electrode 51 formed between the inner surface 56, which faces the center electrode 11, and the two surfaces 59 which are located on opposite sides of the inner surface 56. At this time, preferably, the corners are chamfered at least over a region (R2) from a position in the direction of the axis X corresponding to the front end 20 of the insulation member 21 to the distal end 55 of the ground electrode 51. Further, it is good practice to chamfer the perimetric edge of a distal end surface 55*b* of the ground electrode 51.

Also, in the spark plug 201 having the spark gap G shown in FIG. 8, when the dimensional relation A≦3G is established, where G is the spark gap and A is the shortest gap between the weld bead 6 of the noble metal tip 1 and the line L1 drawn in parallel with the axis X of the metallic shell 41 along the inner surface 56 of the proximal end 52 of the ground electrode 51 which faces the center electrode 11, determining the angle θ as mentioned above yields a substantially similar effect as in the case of the spark plug 101.

The above embodiments are described while mentioning laser welding from a single direction. Next, as an example of laser welding from a plurality of directions, laser welding from two directions will be described with reference to FIG. 9. The present example is basically similar to the above-described case where a single protrusion exists, except that the protrusion of a bead exists at two diagonally opposite positions as viewed from the front end of the noble metal tip. Therefore, only points of difference will be described, centering on the state of existence of the protrusions and the positional relation of the protrusions with the ground electrode. In the description, like portions are denoted by like reference numerals. This also applies to the subsequent examples.

Figure 9:
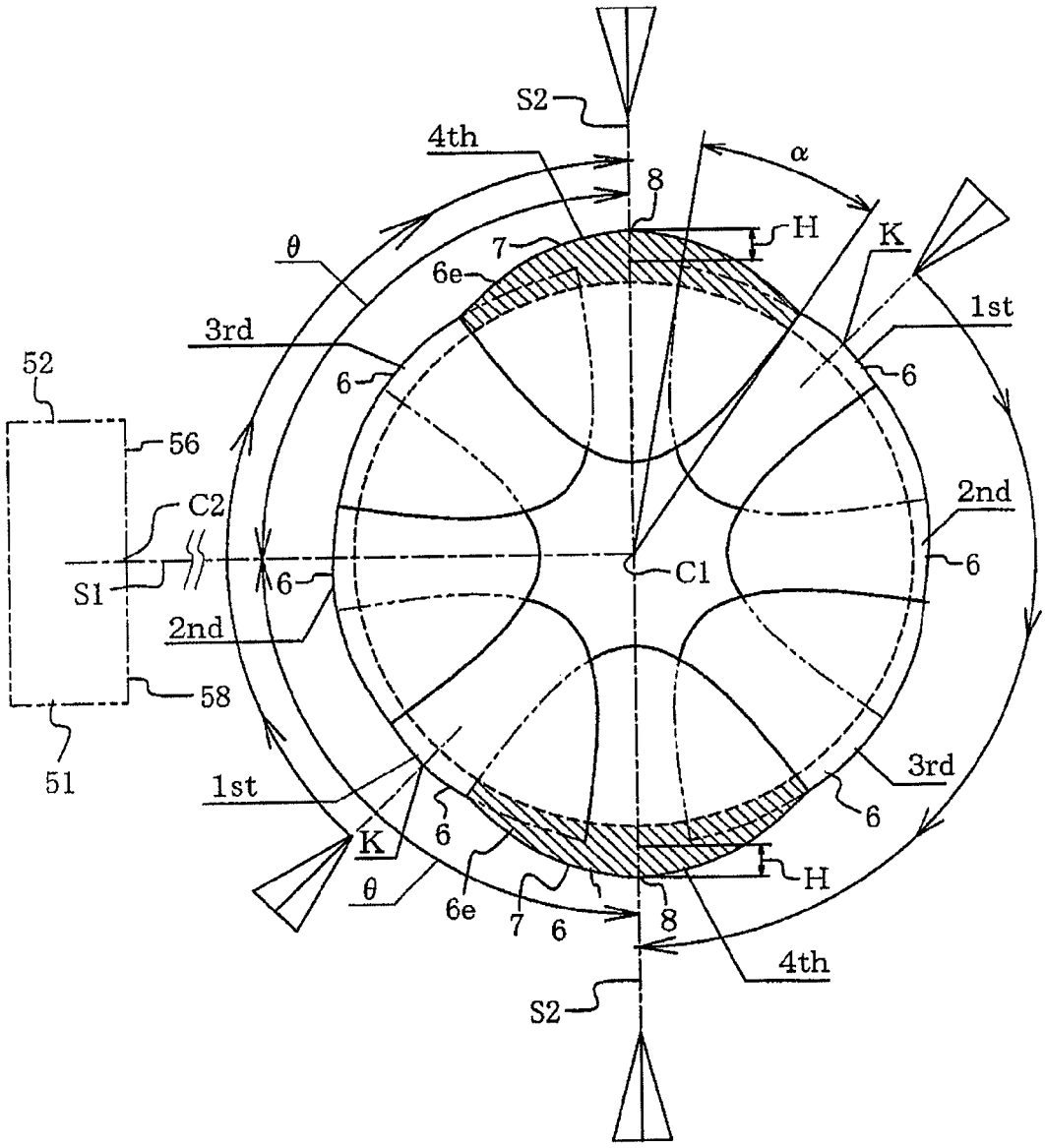
[FIG. 9] Enlarged view, as viewed from the front end of the noble metal tip, for schematically explaining weld beads formed by laser-welding a center electrode base metal and the noble metal tip together from two directions.

In FIG. 9, the circular columnar noble metal tip is concentrically positioned on the front end surface of the center electrode base metal, and two laser welding machines are disposed for laser-welding together the outer circumferential edges of joint surfaces of the two members from two directions at two positions located diagonally from each other (180 degrees apart from each other) with the center C1 of the joint surfaces therebetween. After the circular columnar noble metal tip is concentrically positioned on the front end surface of the center electrode base metal, pulse laser welding is performed. FIG. 9 schematically shows the weld beads 6 and 6*e* formed after positioning by performing pulse laser welding as follows: while the center electrode base metal is turned about its axis near one-half turn (e.g., 135 degrees), a pulse laser is shot from each of the two directions at four positions located at equal angular intervals, ranging from the turn start (stop) position for the 1st shot to the position for the final 4th shot.

In the present example, as represented by hatching in FIG. 9, as viewed in the axial direction from the front end of the noble metal tip, in contrast to the beads 6 formed by pulse laser welding of the 1st to the 3rd shots, each of the two beads 6*e* formed by pulse laser welding of the final 4th shot is formed such that opposite ends thereof overlie the bead 6 formed by the preceding 3rd shot and the bead 6 formed by the 1st shot of the other laser welding machine. As a result, the bead 6*e* formed by the final 4th shot exists at two positions located diagonally from each other (180 degrees apart from each other) with the center C1 of the tip therebetween; the bead 6*e* assumes the form of the protrusion (patched portion in FIG. 9) 7 which is formed (mounded) a slight amount H higher in the radially outward direction than are the other beads 6; and, as viewed from the axial direction, the circumferential center of the protrusion 7 is the vertex 8 which projects most in the radially outward direction. That is, in FIG. 9, the irregular projection or mound-like protrusion 7, which is relatively high in the radial direction, exists at two positions. Therefore, in the case of the present example, the spark plug may be assembled as follows: as shown in FIG. 9, neither of the vertexes 8 of the two protrusions 7 exist on the straight line S1 which connects the center C1 of the noble metal tip and the circumferential center C2 of the proximal end 52 of the ground electrode 51, and the vertexes 8 of the two protrusions 7 are located circumferentially away from the straight line S1.

In the present example, the two protrusions 7 are located circumferentially opposite to each other; thus, preferably, a portion of the bead 6 which is located at the circumferentially middle position between the two protrusions 7 or located toward the middle position and which is relatively low in the radial direction exists on the straight line S1 which connects the center C1 of the noble metal tip and the circumferential center of the proximal end 52 of the ground electrode 51. In other words, preferably, as shown in FIG. 9, the angle θ formed between the straight line S1 and the straight line S2 which connects the vertex 8 of each of the protrusions 7 and the center C1 of the noble metal tip is 90 degrees (or about 90 degrees). In the case of laser welding from three directions at three positions located circumferentially at equal angular intervals, although unillustrated, the protrusions are arranged at 120-degree intervals; therefore, the angle θ is 60 degrees at maximum. Preferably, in assembly of the spark plug, the positional relation of the protrusions with the ground electrode 51 of the metallic shell is adjusted so as to hold an angle θ of at least 45 degrees or greater.

Figure 10:
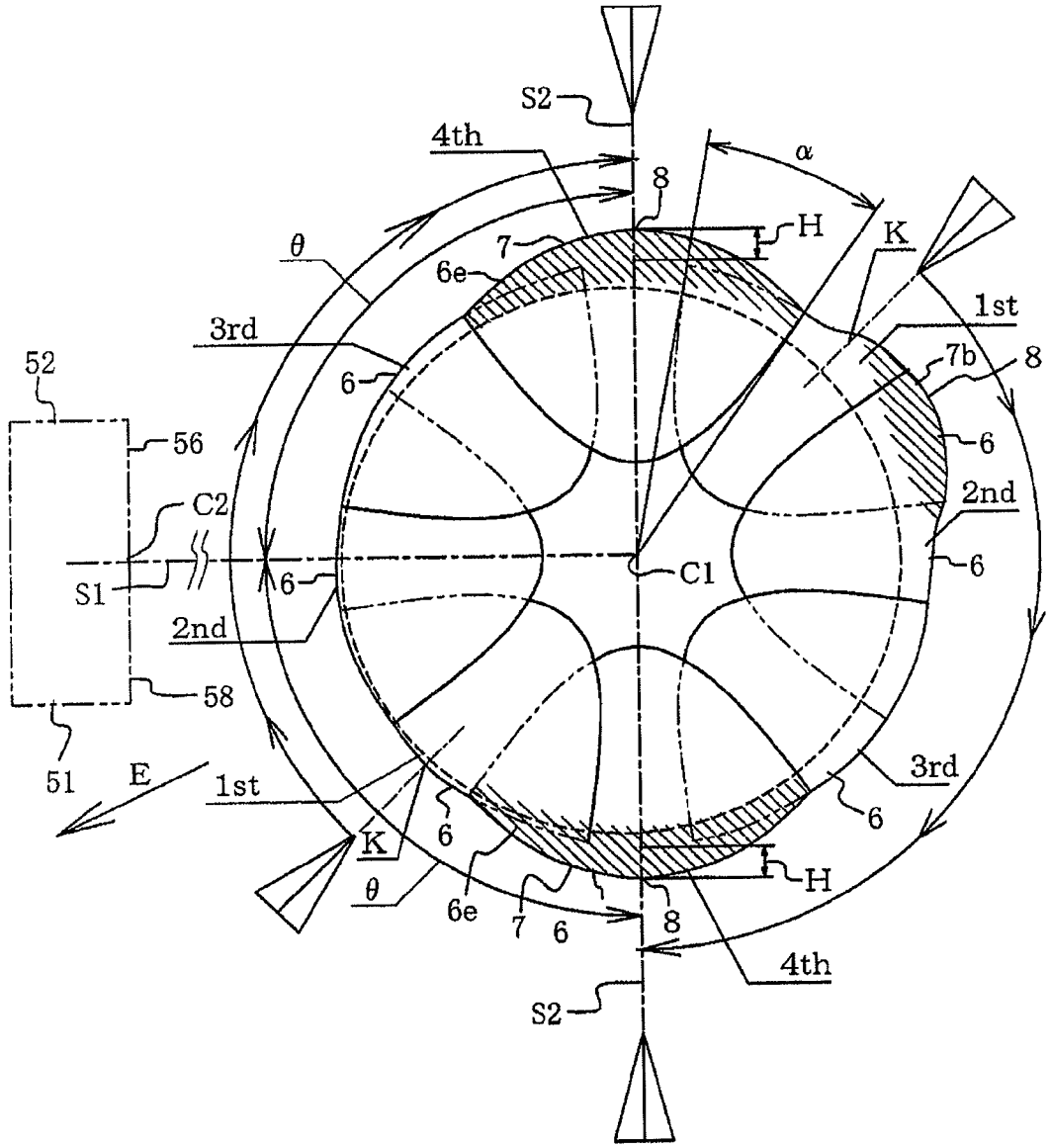
[FIG. 10] View of FIG. 9 with a center-runout-induced protrusion added.

In the above description, laser welding is performed from two directions, so that the protrusion 7 is formed at two final beads 6*e*. FIG. 10 shows an example in which, in addition to the protrusions 7, there exists a protrusion 7*b* formed in association with center runout which arises independently of the formation of the protrusions 7. The protrusion 7*b* of FIG. 10 is formed in the following case: when, in the previous example, the circular columnar noble metal tip 1 is to be concentrically positioned on the front end surface 13 of the center electrode base metal 10, as shown in FIG. 11B, the noble metal tip 1 is positioned on the front end surface 13 of the center electrode base metal 10 in such a manner that a relatively large center runout D1 in the direction of arrow E exists, and, as shown in FIG. 11C, the noble metal tip 1 is welded while the center runout D1 exists. In this case, as in the case of the bead 6*e* at the final end portion of welding, as shown at the upper right of FIG. 10, the associated bead 6 forms the protrusion 7*b* which is formed relatively high in the radial direction. Thus, in the example of FIG. 10, there exist three protrusions including the two bead end protrusions 7.

In this example, the maximum circumferential interval between two protrusions is the circumferential interval between the two protrusions 7 at the bead ends 6*e* between which the protrusion caused by center runout does not exist. Thus, a favorable positional relation is as shown in FIG. 10; specifically, a bead portion existing within the circumferential interval between the two protrusions 7 at the bead ends 6*e* faces a side toward the proximal end 52 of the ground electrode 51, and the vertexes 8 of the two protrusions 7 are located circumferentially away from the straight line S1 which connects the center C1 of the noble metal tip and the circumferential center of the proximal end 52 of the ground electrode 51. That is, in the present example, the two protrusions 7 at the bead ends 6*e* are resultantly held in the same positional relation as in the case of the previous example.

Figure 11:
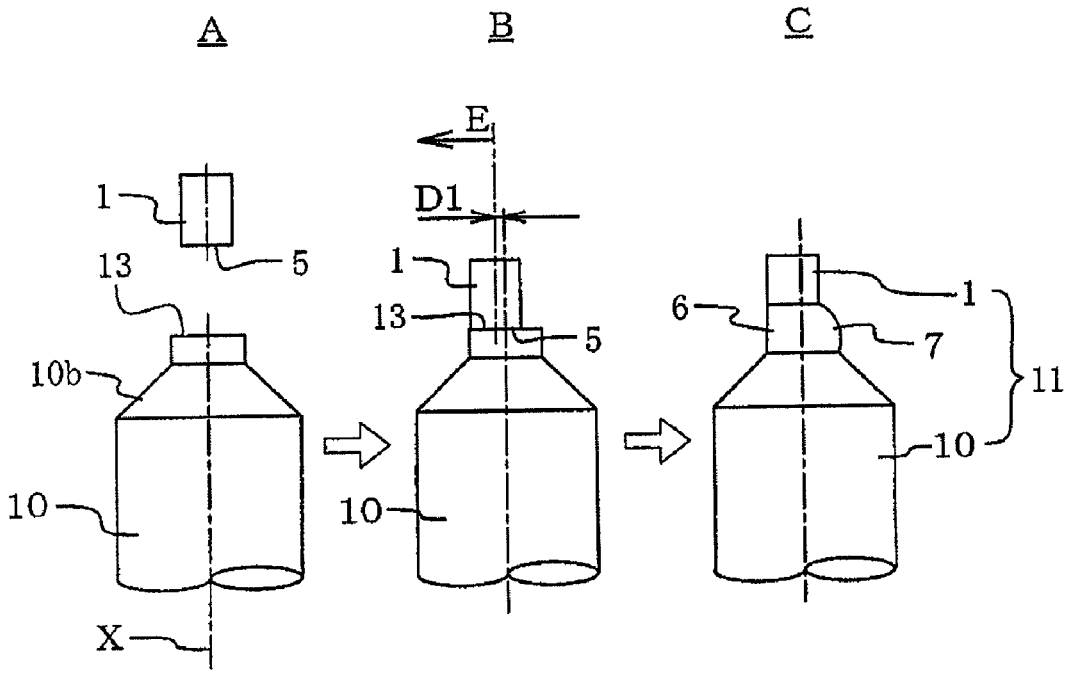
[FIG. 11] View for explaining a process in which a protrusion is formed from center runout.
Figure 12:
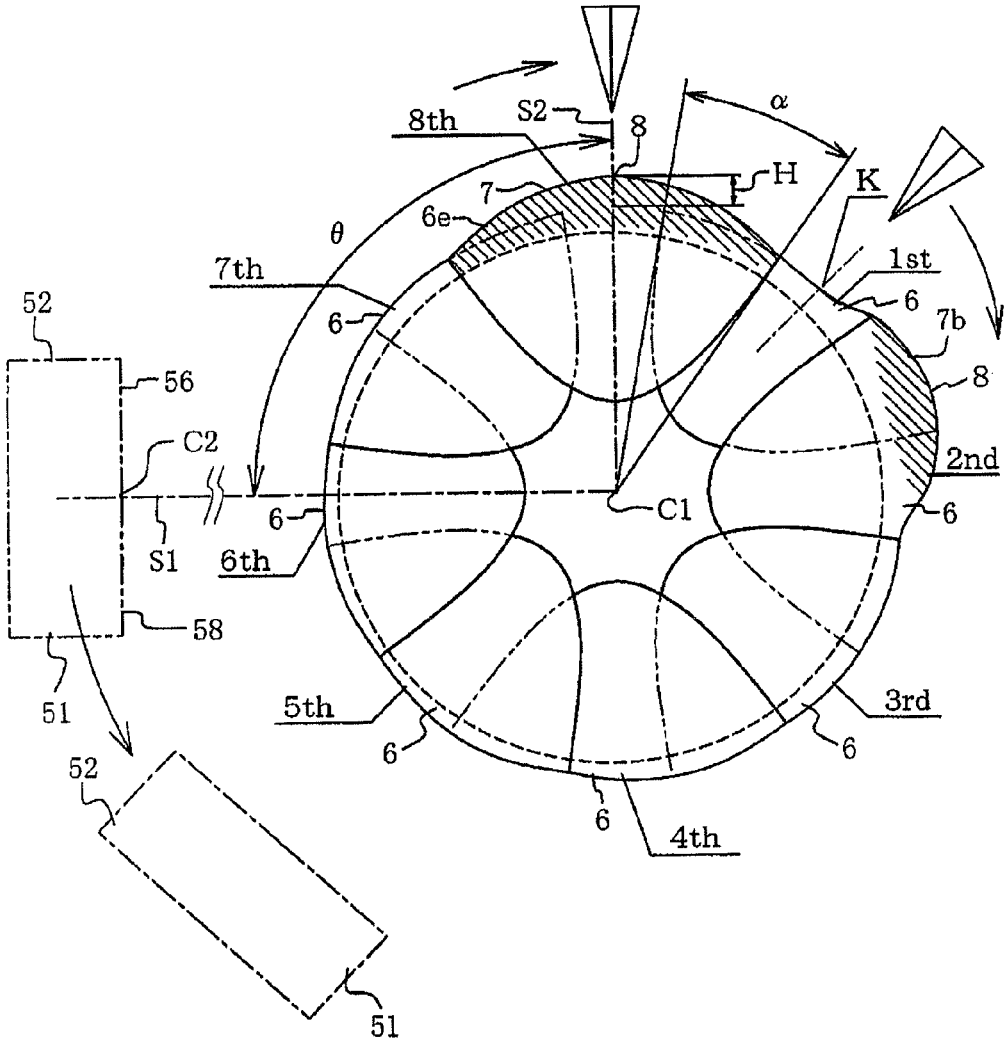
[FIG. 12] Enlarged view, as viewed from the front end of the noble metal tip, for schematically explaining weld beads formed by laser-welding the center electrode base metal and the noble metal tip together from a single direction, with a center-runout-induced protrusion added.

Even in the case of laser welding from a single direction, as shown in FIG. 11, the noble metal tip 1 may be welded on the front end surface 13 of the center electrode base metal 10 in a state in which a relatively large center runout D1 exists. In this case, as shown in FIG. 12, two protrusions; i.e., the protrusion 7 at the bead end 6*e* and the protrusion 7*b* stemming from center runout, exist in the circumferential direction. In FIG. 12, the protrusion 7*b* stemming from center runout is located in a similar manner as in the case of FIG. 10. Meanwhile, the position of the protrusion 7*b* stemming from center runout is independent of the bead end 6*e*. Thus, as shown in FIG. 12, the two protrusions 7 and 7*b* may be located in proximity to each other. In this case, the circumferential interval between the two protrusions 7 and 7*b* differs greatly between a side on which the two protrusions 7 and 7*b* are close to each other and an opposite side located diagonally with respect to the center C1. Therefore, in this case, a favorable positional relation is as follows: a bead portion (bead 6) existing within the maximum circumferential interval between the two protrusions 7 and 7*b* faces a side toward the proximal end 52 of the ground electrode 51, and the vertexes 8 of the two protrusions 7 and 7*b* are located circumferentially away from the straight line S1 which connects the center C1 of the noble metal tip and the circumferential center of the proximal end 52 of the ground electrode 51. In FIG. 12, the angle θ between the straight line S1 and the straight line S2 is about 90 degrees. However, in order to further increase the angle θ, the position of the proximal end 52 of the ground electrode 51 may be relatively moved to the position represented by the dot-dash line in FIG. 12. That is, a favorable positional relation is such that the two protrusions 7 and 7*b* do not exist in a circumferential region (half-circumference region) which faces the proximal end 52 of the ground electrode 51.

As described above, according to the present invention, preferably, the spark plug is assembled as follows: when the spark plug is viewed in the axial direction from the front end of the noble metal tip, the vertex of a protrusion (a protrusion at bead end or a protrusion stemming from center runout) formed relatively high in the radial direction in a bead formed by circumferential laser welding does not exist on the straight line which connects the center of the noble metal tip and the circumferential center of the proximal end of the ground electrode, and is located circumferentially away from the straight line to the greatest possible extent. Thus, in the case of a single protrusion, positioning the protrusion is easy. However, in the case of a plurality of protrusions, it is important to position the protrusions in such a manner that any of the vertexes of the protrusions is located circumferentially away from the straight line. Thus, preferably, a bead portion existing within the maximum circumferential interval between two protrusions faces a side toward the proximal end of the ground electrode, and the vertexes of the two protrusions are located circumferentially the same or substantially the same distance or angular interval away from the straight line which connects the center of the noble metal tip and the circumferential center of the proximal end of the ground electrode. Similar to the case of a single protrusion, the circumferential existence of a plurality of protrusions can be embodied in spark plugs similar to those of the above embodiments.

Next, a specific method of manufacturing (assembling) a spark plug for embodying the present invention will be described. The manufacturing method has been described above to a certain extent, but what is important for the manufacturing method is how the gist of the present invention is embodied. Specifically, the point is that, when the spark plug is viewed in the axial direction from the front end of the noble metal tip, the vertex of a protrusion formed relatively high in the radial direction in a bead formed by circumferential laser welding does not exist on the straight line which connects the center of the noble metal tip and the circumferential center of the proximal end of the ground electrode, and is located circumferentially away from the straight line. Except for this point, the manufacturing method is similar to a publicly known method of manufacturing a spark plug. The publicly known method of manufacturing a spark plug includes a step of assembling an insulation member assembly by inserting component members including a center electrode having a noble metal tip welded to a front end thereof into an insulation member in the form of a hollow shaft, and disposing component members including a terminal electrode rearward of the center electrode so as to fix the component members including the center electrode within the insulation member; a step of inserting the insulation member assembly in which the component members including the center electrode are fixedly inserted, into a tubular metallic shell having a ground electrode provided at a front end thereof, from a rear end of the metallic shell; and a crimping step of crimping the metallic shell for fixing within the metallic shell the insulation member assembly inserted into the metallic shell.

Thus, the spark plug of the present invention may be assembled in the following manner: the vertex of a protrusion formed relatively high in the radial direction in a bead formed by circumferential laser welding does not exist on the straight line which connects the center of the noble metal tip and the circumferential center of the proximal end of the ground electrode, and is located circumferentially away from the straight line. Next, a specific method of manufacturing the spark plug will be described with reference to FIG. 13 on the basis of the publicly known manufacturing method.

Figure 13:
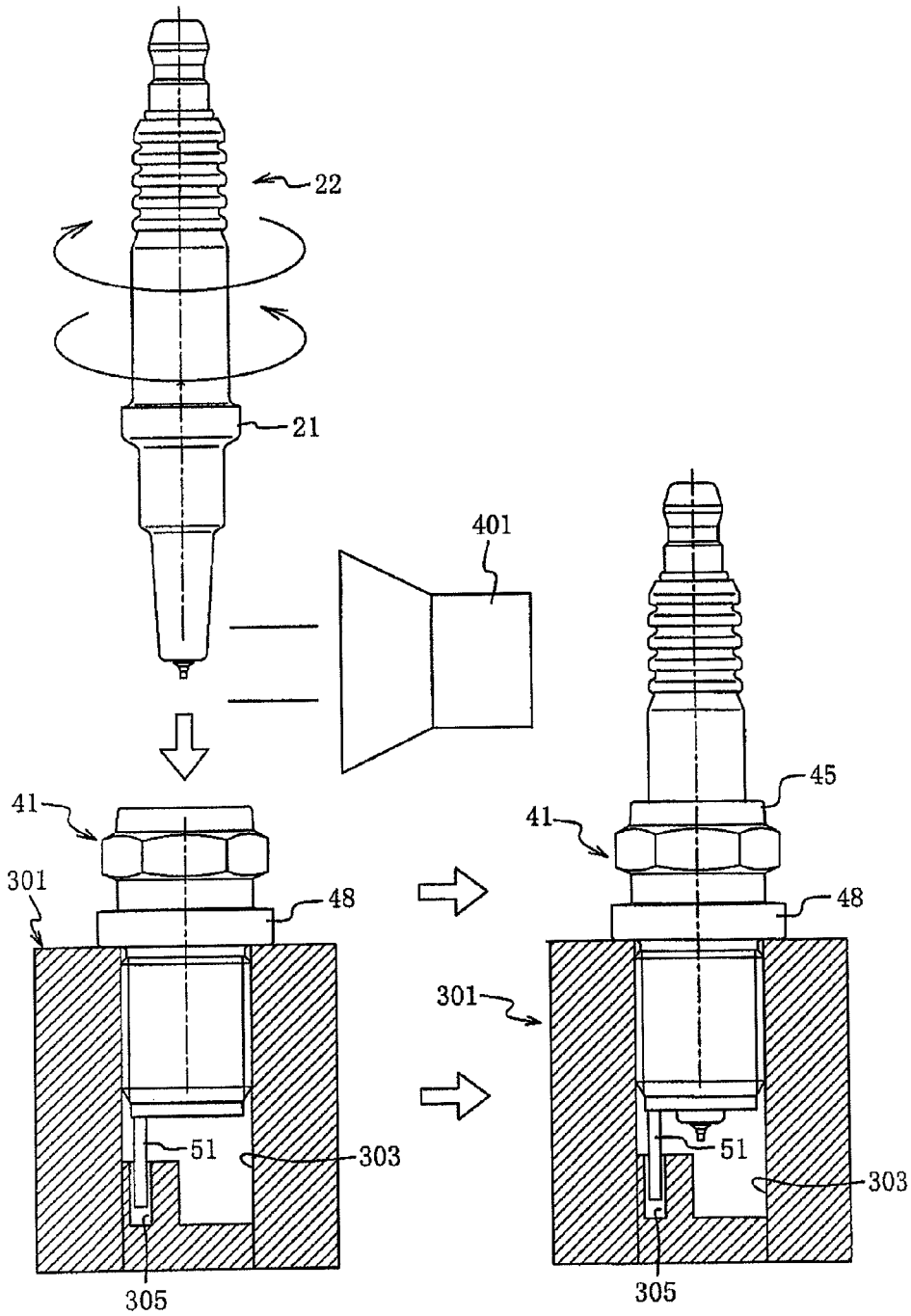
[FIG. 13] View for explaining a method of manufacturing the spark plug of the present invention.

As shown at the left of FIG. 13, a positioning jig 301 for the metallic shell 41 is prepared. The positioning jig 301 has a hole 303 which can accommodate the mounting screw 46 located at a front end portion of the metallic shell 41 with substantially no clearance existing therebetween. The metallic shell 41 is formed such that the seating ring flange portion 48 thereof is seated on the upper surface (a circumferential portion around the opening of the hole) of the positioning jig 301. The positioning jig 301 has a recess portion (a positioning portion for positioning the ground electrode 51 about the axis of the metallic shell 41) 305 provided deep in the hole 303 and adapted to position the ground electrode 51 when the metallic shell 41 having the ground electrode 51 welded to the front end thereof is inserted into the hole 303 of the positioning jig 301 with the front end thereof facing down. Thus, the metallic shell 41 is inserted from its front end into the hole 303, and the ground electrode 51 is inserted into the recess portion 305. By this procedure, the metallic shell 41 is held by the positioning jig 301 while the ground electrode 51 is circumferentially positioned about the axis. In this stage of manufacture, the ground electrode 51 extends straight frontward from the front end of the metallic shell 41. After the insulation member assembly is fixed in place, the straight ground electrode 51 is bent toward the center electrode.

Next, the insulation member assembly (the workpiece shown at the upper left of FIG. 13) 22 assembled such that component members including the center electrode are fixed within the insulation member 21 is chucked by a chuck provided at an end of an unillustrated insulation member assembly feed arm, which can insert the insulation member assembly 22 into the metallic shell 41 from the rear end of the metallic shell 41. The chuck has a turn adjustment means for adjusting the turn of the insulation member assembly 22 about the axis. In the present example, before the insulation member assembly 22 is inserted into the metallic shell 41, the radial height of a weld bead of the noble metal tip located at the front end of the insulation member assembly 22 is detected by detection means along the circumference of the noble metal tip. On the basis of the detected data, adjustment is made on the position of the vertex of a protrusion of the bead about the axis relative to the straight line which connects the center of the noble metal tip and the circumferential center of the proximal end of the ground electrode 51. Specifically, on the basis of the detected data, a circumferential position (reference position) which must face a side toward the proximal end of the ground electrode is determined, and the chucked insulation member assembly 22 is turned by the turn adjustment means of the chuck so as to make the reference position face the side toward the proximal end of the ground electrode.

After the chucked insulation member assembly 22 is turned as mentioned above, the feed arm is driven so as to coincide the insulation member assembly 22 with the axis of the metallic shell 41 and to insert the insulation member assembly 22 into the metallic shell 41 as shown at the right of FIG. 13. As aforesaid, the O ring 37, the talc 38, and the O ring 37 are disposed between the insulation member assembly 22 and the inner surface of the rear large-diameter tubular portion of the metallic shell 41 (see FIG. 1). Subsequently, the crimp cylinder portion 45 at the rear end of the metallic shell 41 is bent inward for crimping and is plastically deformed through frontward compression. After the insulation member assembly is fixed within the metallic shell, the ground electrode 51 is bent into a predetermined shape, thereby yielding the spark plug 101 having the structure shown in FIG. 1. The radial height of weld bead of the noble metal tip of the insulation member assembly 22 may be detected before the crimping step. Therefore, the detecting operation can be performed in the course of or after inserting the insulation member assembly 22 into the metallic shell 41. However, performing the detecting operation before insertion into the metallic shell 41 as in the case of the present example is easy and is thus preferred.

The radial height of a bead may be detected by any of various publicly known detection means and measuring means, such as laser measuring or enlarged-image processing using a camera. In FIG. 13, while the insulation member assembly 22 is turned one turn about its axis, a camera 401 captures an image of the radial protrusion (the contour of the outer circumferential surface) of a circumferential bead from the lateral direction relative to the noble metal tip, and the captured image is subjected to enlarged-image processing for obtaining the radial height of the bead. In place of image capture by camera, laser measuring may be employed. The radial height of a bead can also be detected as follows: the camera 401 captures an image of the noble metal tip from the front end of the noble metal tip, and the captured image is subjected to enlarged-image processing. The radial height of a bead is detected in the circumferential direction by an appropriate measuring means; on the basis of the detected data, a surface (reference position) which must face the proximal end of the ground electrode is determined; and the turn adjustment means is driven according to a predetermined program to cause the thus-determined reference position to face a side toward the proximal end of the ground electrode.

DESCRIPTION OF REFERENCE NUMERALS

1: noble metal tip
3: front end of noble metal tip
6, 6*e*: laser weld bead
7: protrusion formed relatively high in radial direction at final end portion of bead
7*b*: center-runout-induced protrusion in bead
8: vertex of protrusion
10: center electrode base metal
11: center electrode
13: front end of center electrode
21: insulation member
40: front end of metallic shell
41: metallic shell
51: ground electrode
52: proximal end of ground electrode
52*b*: circumferential center of proximal end of ground electrode
55: distal end of ground electrode
56: inner surface of ground electrode facing center electrode
59: surfaces on opposite sides of inner surface
60: chamfer
101, 201: spark plug
G: spark gap (regular gap)
A: lateral gap
C1: center of front end of noble metal tip
C2: circumferential center of proximal end of ground electrode
S1: straight line connecting center of front end of noble metal tip and circumferential center of proximal end of ground electrode
S2: straight line connecting vertex of protrusion of bead and center of noble metal tip
θ: angle between straight lines S1 and S2
X: axis

The invention claimed is:

1. A spark plug comprising an insulation member assuming the form of a hollow shaft and having a center electrode disposed at a front end thereof, and a metallic shell surrounding the insulation member and having a ground electrode disposed at a front end thereof and adapted to form a spark gap in cooperation with the center electrode, the center electrode being formed by welding a noble metal tip to a front end of a center electrode base metal in such a manner that laser welding is performed in a circumferential direction along a circumference of a joint surface between the center electrode base metal and the noble metal tip in excess of full circumference, the spark plug being characterized in that when G represents a spark gap between the center electrode and the ground electrode and A represents a shortest gap between a laser weld bead and a line drawn in parallel with an axis X of the metallic shell along an inner surface of a proximal end portion of the ground electrode which faces the center electrode, G and A establish a dimensional relation $A \leqq 3G$, and when the spark plug is viewed in an axial direction from a front end of the noble metal tip, a vertex of a protrusion formed relatively high in a radial direction in a bead formed by circumferential laser welding does not exist on a straight line which connects a center of the noble metal tip and a circumferential center of a proximal end of the ground electrode, and is located circumferentially away from the straight line.

2. A spark plug according to claim 1, wherein the protrusion exists at a plurality of positions in the circumferential direction; none of the vertexes of the protrusions exist on the straight line which connects the center of the noble metal tip and the circumferential center of the proximal end of the ground electrode; and the vertexes of the protrusions are located circumferentially away from the straight line.

3. A spark plug according to claim 1, wherein the protrusion exists at a plurality positions in the circumferential direction; a bead portion existing within a maximum circumferential interval between two protrusions faces a side toward the proximal end of the ground electrode; and the vertexes of the two protrusions are located circumferentially away from the straight line which connects the center of the noble metal tip and the circumferential center of the proximal end of the ground electrode.

4. A spark plug according to claim 1, wherein, when the spark plug is viewed in the axial direction from the front end of the noble metal tip, the straight line which connects the center of the noble metal tip and the circumferential center of the proximal end of the ground electrode and a straight line which connects the center of the noble metal tip and the vertex of the protrusion formed relatively high in the radial direction in the bead formed by circumferential laser welding form an angle θ of 45 degrees or greater.

5. A spark plug according to claim 4, wherein the angle θ is 90 degrees or greater.

6. A spark plug according to claim 1, wherein the ground electrode extends frontward from the front end of the metallic shell, and a distal end of the ground electrode is bent toward the noble metal tip so as to form a spark gap in cooperation with a front end surface of the noble metal tip.

7. A spark plug according to claim 6, wherein the ground electrode is chamfered in such a manner that corners formed between an inner surface of the ground electrode which faces the center electrode, and surfaces of the ground electrode which are adjacent to the inner surface are chamfered at least at portions corresponding to a length of a projecting portion of the center electrode projecting in the axial direction from the front end of the insulation member.

8. A spark plug according to claim 1, wherein the ground electrode extends frontward from the front end of the metallic shell, and a distal end of the ground electrode is bent toward the noble metal tip so as to form a spark gap in cooperation with an outer circumferential surface of the noble metal tip.

9. A spark plug according to claim 8, wherein the ground electrode is chamfered in such a manner that corners formed between an inner surface of the ground electrode which faces the center electrode, and surfaces of the ground electrode which are adjacent to the inner surface are chamfered at least over a range from a position in the axial direction corresponding to the front end of the insulation member to the distal end of the ground electrode.

10. A spark plug according to claim 1, wherein the ground electrode has a noble metal tip laser-welded thereto.

11. A spark plug according to claim 1, wherein the laser welding is pulse laser welding.

12. A method of manufacturing a spark plug comprising:

a step of assembling an insulation member assembly by inserting component members including a center electrode having a noble metal tip welded to a front end thereof into an insulation member in the form of a hollow shaft, and disposing component members including a terminal electrode rearward of the center electrode so as to fix the component members including the center electrode within the insulation member;

a step of inserting the insulation member assembly in which the component members including the center electrode are fixedly inserted, into a tubular metallic shell having a ground electrode provided at a front end thereof, from a rear end of the metallic shell; and a crimping step of crimping the metallic shell for fixing within the metallic shell the insulation member assembly inserted into the metallic shell;

the method being characterized in that:

in manufacture of the spark plug according to claim 1, while the metallic shell is positioned such that the ground electrode is located at a predetermined position around an axis of the metallic shell, in a period from a stage before inserting the insulation member assembly into the metallic shell to a stage of crimping the metallic shell in the crimping step, a radial height of the bead is detected by detection means along a circumference of the noble metal tip, and, on the basis of the detected data, adjustment is made on a position of the vertex of the protrusion about the axis relative to the straight line which connects the center of the noble metal tip and the circumferential center of the proximal end of the ground electrode.

13. A method of manufacturing a spark plug comprising:

a step of assembling an insulation member assembly by inserting component members including a center electrode having a noble metal tip welded to a front end thereof into an insulation member in the form of a hollow shaft, and disposing component members including a terminal electrode rearward of the center electrode so as to fix the component members including the center electrode within the insulation member;

a step of inserting the insulation member assembly in which the component members including the center electrode are fixedly inserted, into a tubular metallic shell having a ground electrode provided at a front end thereof, from a rear end of the metallic shell; and a crimping step of crimping the metallic shell for fixing within the metallic shell the insulation member assembly inserted into the metallic shell;

the method being characterized in that:

in manufacture of the spark plug according to claim 1, while the metallic shell is positioned such that the ground electrode is located at a predetermined position around an axis of the metallic shell, before the insulation member assembly is inserted into the metallic shell, a radial height of the bead is detected by detection means along a circumference of the noble metal tip, and, on the basis of the detected data, adjustment is made on a position of the vertex of the protrusion about the axis relative to the straight line which connects the center of the noble metal tip and the circumferential center of the proximal end of the ground electrode.

14. A method of manufacturing a spark plug according to claim 12, wherein the detection means is implemented by processing an image captured by a camera.

15. A method of manufacturing a spark plug according to claim 12, wherein the detection means is implemented by laser measurement.

* * * * *